US005170003A

United States Patent [19]

Kawashima

[11] Patent Number: 5,170,003

[45] Date of Patent: Dec. 8, 1992

[54] ELECTRONIC MUSICAL INSTRUMENT FOR SIMULATING A WIND INSTRUMENT

[75] Inventor: Susumu Kawashima, Hamamatsu, Japan

[73] Assignee: Yamaha Corporation, Hamamatsu, Japan

[21] Appl. No.: 541,785

[22] Filed: Jun. 21, 1990

[30] Foreign Application Priority Data

Jun. 22, 1989 [JP] Japan ..... 1-160344
Jun. 22, 1989 [JP] Japan ..... 1-160345
Jun. 23, 1989 [JP] Japan ..... 1-73690[U]

[51] Int. Cl.[5] ..... G10H 1/14; G10H 9/00; G10H 1/46

[52] U.S. Cl. ..... 84/619; 84/626; 84/658; 84/615

[58] Field of Search ..... 84/611, 644, 711, DIG. 12, 84/DIG. 7, 724, DIG. 14, 718, 741, 619, 609, 615, 622, 626, 647, 653, 657, 658, 670, 687, 445

[56] References Cited

U.S. PATENT DOCUMENTS 4,083,287 4/1978 Suzuki ..... 84/377
4,237,766 12/1980 Marshall ..... 84/377
4,385,541 5/1983 Müller et al. ..... 84/DIG. 14
4,419,916 12/1983 Aoki ..... 84/609
4,502,362 3/1985 Zacharias ..... 84/DIG. 14
4,566,363 1/1986 Ari .
4,619,175 10/1986 Matsuzaki .
4,658,697 4/1987 Wean ..... 84/398
4,704,938 11/1987 Zacharias ..... 84/377
4,889,026 12/1989 Abe ..... 84/611
4,915,008 4/1990 Sakashita ..... 84/658
4,957,032 9/1990 Hirano et al. ..... 84/619
4,993,307 2/1991 Sakashita ..... 84/615
4,993,308 2/1991 Villeneuve ..... 84/DIG. 14

FOREIGN PATENT DOCUMENTS 55-126296 9/1980 Japan .
62-3827 1/1987 Japan .
63-298292 12/1988 Japan .

*Primary Examiner*—William M. Shoop, Jr.
*Assistant Examiner*—Helen Kim
*Attorney, Agent, or Firm*—Spensley Horn Jubas & Lubitz

[57] ABSTRACT

An electronic musical instrument which simulates an acoustic wind instrument and the like is designed to generate a musical tone having a desirable tone pitch in response to breath pressure applied thereto by a performer. Preferably, the electronic musical instrument has a shape like the wind instrument, so that the breath pressure includes breath blowing pressure and breath sucking pressure. For example, generation of the musical tone is controlled in response to the breath blowing pressure, while the predetermined musical parameter such as the tone color, accompaniment and rhythm is controlled in response to the breath sucking pressure.

6 Claims, 20 Drawing Sheets

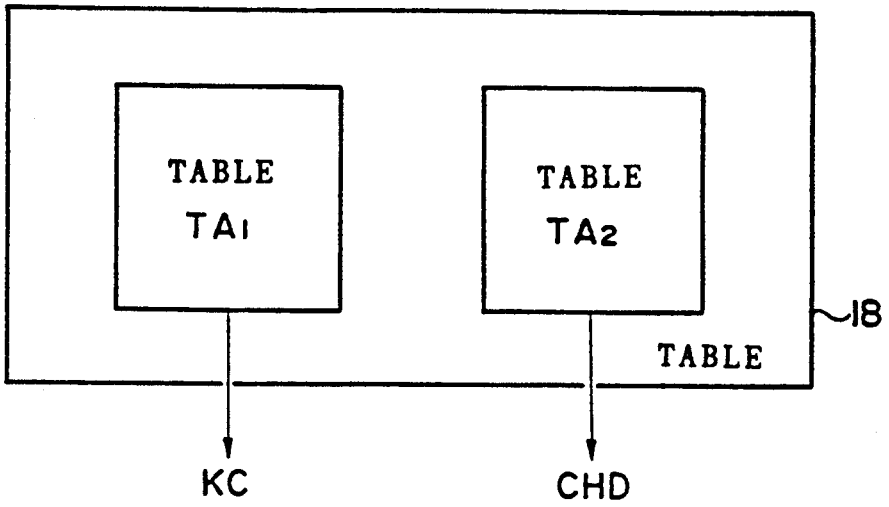
FIG.3
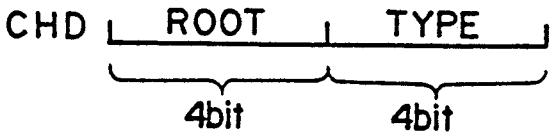
FIG.4
| KEY | ---C2 ---- C3 ---- B3 C4 C4# ---- C5 ---- C6--- |
|---|---|
| KEY CODE (KC) | ---36 ---- 48 ---- 59 60 61 ---- 72 ---- 84--- |
FIG.5

(INITIALIZATION MODE PROCESS)

(NORMAL MODE PROCESS)

(AUTO-BASS CHORD MODE PROCESS)

(NORMAL RUN MODE PROCESS)

(AUTO-BASS CHORD RUN MODE PROCESS)

(SEQUENCER RECORD WAIT MODE PROCESS)

(SEQUENCER RECORD RUN MODE PROCESS)

(SEQUENCER PLAY WAIT MODE PROCESS)

(SEQUENCER PLAY RUN MODE PROCESS)

(CLOCK INTERRUPT PROCESS)

(SEQUENCER READ MODE PROCESS)

(SEQUENCER START MODE PROCESS)

ELECTRONIC MUSICAL INSTRUMENT FOR SIMULATING A WIND INSTRUMENT

BACKGROUND OF THE INVENTION

1. Field of the Invention

The present invention relates to an electronic musical instrument which can generate tones of a wind instrument and the like.

2. Prior Art

Conventionally, there is provided an electronic musical instrument which simulates the acoustic wind instrument such as the recorder and flute. Like the acoustic wind instrument, this electronic wind instrument provides the predetermined number of keys by which a plurality of tone pitches can be designated. This electronic wind instrument generates the sound in response to the breath applied thereto.

The above-mentioned conventional electronic wind instrument designates the tone pitch by operating plural keys by fingers of a performer, so that it requires the specific performance technique exclusively used when performing the wind instrument. However, there is a problem in that when simulating the sounds of other instruments by use of the conventional electronic musical instrument, the performance of other instruments cannot be carried out due to the special relationship between the key operation and breath which simulate the acoustic wind instrument. For example, when performing the accompaniment in addition to the melody, it is difficult for the conventional electronic wind instrument to control the accompaniment.

For example, if complicated finger operation is required for the electronic wind instrument when performing the music with tonality other than regular tonality, e.g., C major or C minor, it is very difficult for the performer to play the music according to the score. Even if music consisting of notes belonging to plural octaves is played in the same tonality, e.g., C major or C minor, octave change must complicate the finger operation of performer.

In order to ease the above-mentioned difficulty, Japanese Patent Laid-Open Publication No. 55-126296 entitled "ELECTRONIC MUSICAL INSTRUMENT WITH TRANSPOSITION DEVICE" was invented. The disclosed electronic musical instrument simplifies the finger operation by changing the tonality.

In addition, an automatic accompaniment function can be provided to the above-mentioned electronic musical instrument. Herein, it is possible for the performer to perform the melody with reading out data representative of auto-bass chords (ABC) of the automatic accompaniment from the chord sequencer.

When the tonality is changed with respect to the melody to be performed, such change of tonality affects all of the musical tones to be sounded, by which the accompanied ABC must be subject to the change of tonality (i.e., transposition). As a result, the ABC patter must be out of range of the tone area which is preset in the chord sequencer. For this reason, there is another problem in that the performance cannot be made with the desirable tonality.

There is another type of electronic musical instrument as disclosed in Japanese Patent Laid-Open Publication No. 63-298292 entitled "SEQUENCER OF ELECTRONIC MUSICAL INSTRUMENT". In such electronic musical instrument, plural data banks each storing an arbitrary chord are set in the chord memory; and the access order indicative of the order of sequentially accessing the data banks is programmed by operating the sequence program switches. When performing the music, the automatic performance is carried out in accordance with the pre-stored program by operating the play switch.

However, the electronic musical instrument simulating the wind instrument has a limited number of keys. This makes the operation of program switches and keys complex. Thus, operation for the chord performance affects the finger operation. In other words, there is a further problem in that the operation of changing over the data bank in the middle of the performance may break the performance which must be carried out continuously.

SUMMARY OF THE INVENTION

It is accordingly a primary object of the present invention to provide an electronic musical instrument which can use breath pressure as musical tone control information.

It is another object of the present invention to provide an electronic musical instrument which can perform music requiring complicated finger operation with a simple performance technique.

It is still another object of the present invention to provide an electronic musical instrument which can perform the chords with simple finger operation so that the degree of freedom in the performance thereof can be raised.

In a first aspect of the present invention, there is provided an electronic musical instrument comprising:

(a) designating means for designating a desirable tone pitch;

(b) detecting means for detecting breath pressure including breath blowing pressure and breath sucking pressure to be applied by a performer; and (c) control means for controlling generation of a musical tone in response to a designated tone pitch and detected breath pressure, wherein the musical tone has the designated tone pitch and sound intensity corresponding to the detected breath pressure.

In a second aspect of the present invention, there is provided an electronic musical instrument comprising:

(a) designating means for designating a desirable tone pitch of a musical tone to be generated;

(b) memory means for storing musical tone information corresponding to a musical tone to be generated;

(c) transposition setting means for setting transposition applied to the musical tone to be generated;

(d) transposition storing means for storing transposition information indicating the transposition set by the transposition setting means; and (e) transposition control means for selectively applying the transposition to the musical tone designated by the designating means based on the transposition information, whereby the musical tone designated by the designating means is to be generated based on the musical tone information and the transposition information.

In a third aspect of the present invention, there is provided an electronic musical instrument comprising:

(a) a plurality of data banks each pre-storing automatic performance data;

(b) selecting means for selecting desirable one of the plurality of data banks;

(c) memory means for storing an order by which the data banks are sequentially selected;

(d) reproduction designating means; and (e) control means for setting the memory means at a write enable state within a predetermined time after the reproduction designating means designates that a musical tone is to be reproduced, the control means sequentially designating the data banks by the order stored in the memory means after the predetermined time is passed so that the automatic performance data are sequentially read from the data banks, whereby an automatic performance is to be carried out based on the automatic performance data sequentially read from the data banks under control of the control means.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 3 is a block diagram showing an detailed configuration of a table shown in FIG. 1A;

FIG. 4 shows chord data;

FIG. 5 shows a relationship between a key and a key code;

DESCRIPTION OF THE PREFERRED EMBODIMENT

Figure 1A:
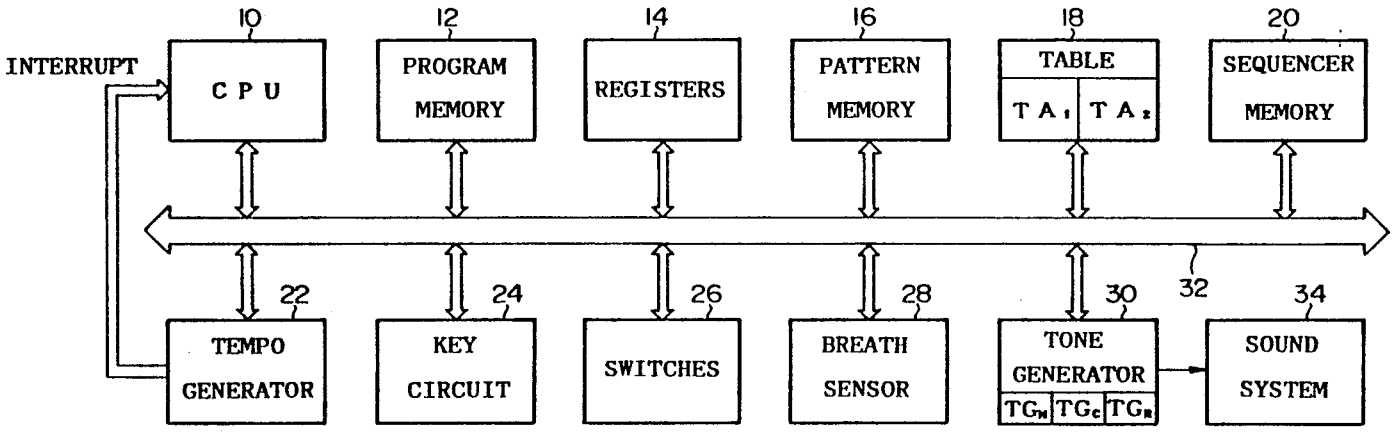
FIGS. 1A and 1B are block diagrams showing an electric configuration of an electronic musical instrument according to an embodiment of the present invention.

Referring now the the drawings, wherein like reference characters designate like or corresponding parts throughout the several views, FIGS. 1A to 24 show the configuration and operation of an electronic musical instrument according to an embodiment of the present invention.

A CONFIGURATION OF EMBODIMENT

(1) Function Circuit Portion

Figure 1B:
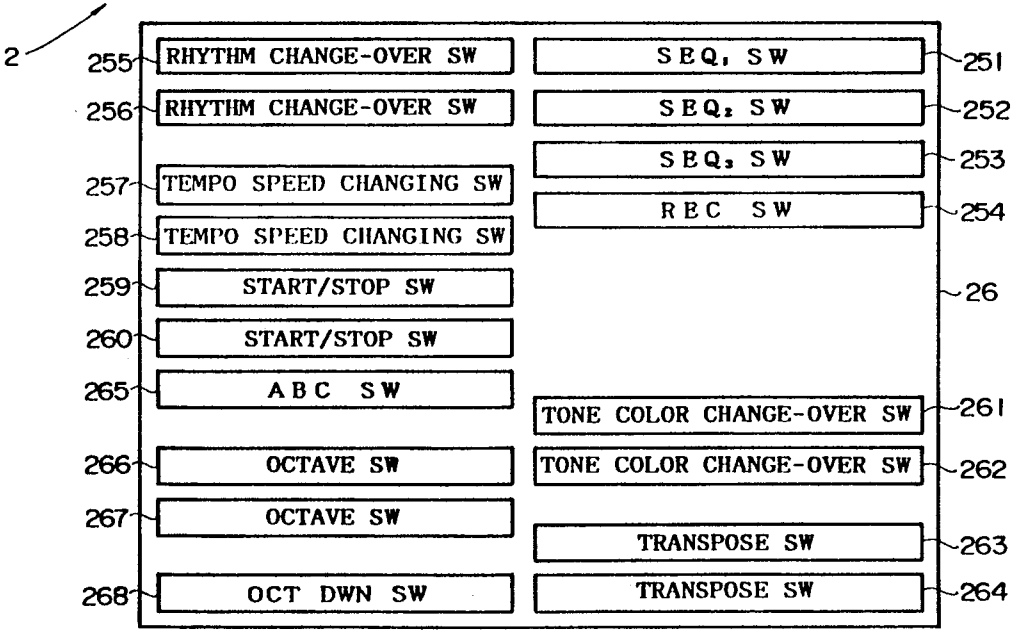

FIGS. 1A and 1B are block diagrams showing the circuit configuration of the electronic musical instrument according to an embodiment of the present invention.

In FIG. 1A, 2 designates a function circuit portion of the electronic musical instrument which electrically embodies the function of a musical instrument. More specifically, this function circuit portion 2 provides a function of controlling the musical tone generation in response to the breath pressure consisting of breath-blowing pressure and breath-sucking pressure. This function circuit portion 2 includes a central processing unit (CPU) 10 for executing operations for the wind instrument, wherein this CPU 10 controls the musical tone generation in response to the breath pressure. This CPU 10 is connected to a program memory 12, registers 14, a pattern memory 16, a table 18, a sequencer memory 20, a tempo generator 22, a key circuit 24, switches 26, a breath sensor 28 and a tone generator 30 via a bi-directional bus 32.

The program memory 12 may be constructed with a read-only memory (ROM) which stores several kinds of control programs for executing the musical tone control, tonality-change control and the like required to carry out the performance operation of the wind instrument, for example.

The registers 14 are used to temporarily store several kinds of data such as chord data, rhythm data, transpose data which are generated when executing the control programs. The registers 14 respectively correspond to areas which are set in a random-access memory (RAM), for example.

The pattern memory 16 can be constructed by either ROM or RAM which stores rhythm patterns and the like.

The table 18 can be constructed by ROM which stores the music data. For example, as shown in FIG. 3, this table 18 includes two tables $TA_1$, $TA_2$. Herein, the table $TA_1$ stores a key code KC, while the table $TA_2$ stores chord data CHD. Therefore, key input is converted into the key code KC by the table $TA_1$ or chord data CHD by the table $TA_2$. In other words, it is possible to obtain the key code KC corresponding to key information from the table $TA_1$.

In the present embodiment, the chord data CHD is 8-bit data consisting of leftmost nybble corresponding to root data ROOT and type data TYPE indicative of the chord type as shown in FIG. 4. Table 1 shows the relationship between ROOT and corresponding note and the relationship between TYPE and corresponding chord. In addition, FIG. 5 shows the relationship between the key and key code KC.

TABLE 1

| ROOT | 0 to 11 | correspond to notes C to B |
|---|---|---|
| TYPE | 0M | |
| | 1 m | |
| | 2 7th | |
| | 3 m7 | |
| | 4 dim. | |
| | 5 aug. | |

Figure 7:
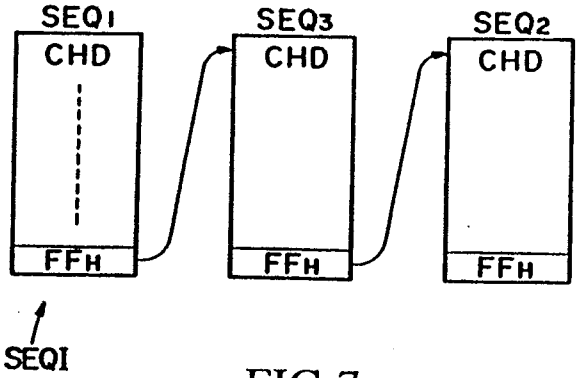
FIG. 7 shows an operation of the sequencer memory.

Meanwhile, the sequencer memory 20 stores the chords and its performance order which are required when performing the automatic accompaniment. For example, this sequencer memory 20 includes two series of sequencers I, II (hereinafter, simply referred to as SEQ I, SEQ II). In the present embodiment, three sequencers $SEQ_1$, $SEQ_2$, $SEQ_3$ are set in SEQ I, while SEQ II stores the data read-out order for sequentially reading the data from sequencers $SEQ_1$, $SEQ_2$, $SEQ_3$. When the data read-out order stores in SEQ II indicates that the data are sequentially read from the sequencers $SEQ_1$, $SEQ_3$, $SEQ_2$, the access is given from $SEQ_1$ to $SEQ_3$ and next access is given from $SEQ_3$ to $SEQ_2$ as shown in FIG. 7.

In SEQ I, CHD indicates the selected chord, duration data DUR indicates the time between the chords, and $FF_H$ indicates an end code. In addition, the duration data DUR is 8-bit data consisting of leftmost nybble $C_H$ and rightmost nybble BT indicating the beat number.

The tempo generator 22 is constructed by an oscillator circuit including an oscillator and a frequency-divider (not shown), which generates a clock pulse indicating the tempo to be required. For example, this clock pulse is used to execute the interruption process in auto-bass chord (ABC) mode.

The key circuit 24 is provided for inputting the key information which is generated when operating the key and the like in order to designate the pitch. This key circuit 24 includes key switches (not shown) operated by plural keys which are mounted on an instrument body 4 shown in FIG. 2A. Thus, the key circuit 24 detects the key-operation and also generates data indicative of the key name with respect to the selectively operated key.

Figure 2C:
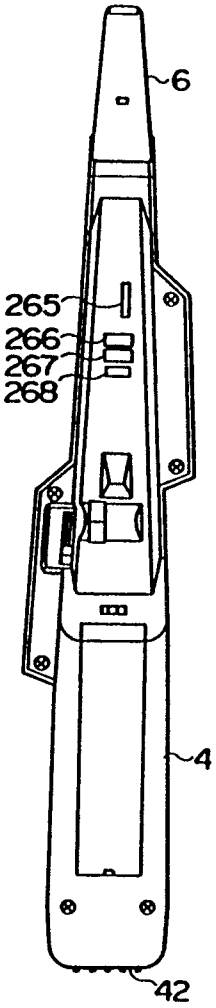
FIGS. 2A to 2C show an appearance of the electronic musical instrument according to an embodiment of the present invention.
Figure 2B:
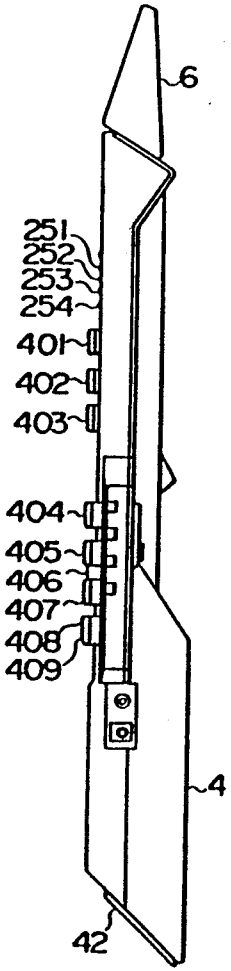

The switches 26 include plural function switches which are provided at the instrument body 4 as shown in FIG. 2B. More specifically, the switches 26 include sequencer selecting switches (i.e., $SEQ_i$ SW representative of $SEQ_1$ SW, $SEQ_2$ SW, $SEQ_3$ SW) 251, 252, 253 by which each of $SEQ_1$, $SEQ_2$, $SEQ_3$ is selected in SEQ I; a record switch (REC SW) 254 by which the data is written in the selected sequencers within $SEQ_1$, $SEQ_2$, $SEQ_3$; rhythm change-over switches 255, 256; tempo speed changing switches 257, 258; start/stop (ST/ST) switches 259, 260; tone color change-over switches 261, 262; transpose change-over switch 263 by which transpose data TRS is increased; another transpose change-over switch 264 by which transpose data TRS is decreased; an ABC switch 265; octave change-over switches 266, 267 by which the octave is changed over; and an octave-down switch (OCT DWN SW) 268 etc. Herein, the transpose change-over switches 263, 264 are provided for setting the arbitrary transposition quantity.

Next, the breath sensor 28 detects the breath pressure, i.e., breath-blowing pressure and breath-sucking pressure. This breath sensor 28 is mounted at a mouth-piece 6 which is provided in the wind instrument. Thus, the breath sensor 28 electrically detects the breath pressure applied to the mouth-piece 6 by the performer to thereby generate breath data.

The tone generator 30 provides a melody tone generator $TG_M$, an accompaniment tone generator $TG_C$ and a rhythm tone generator $TG_R$. Thus, the tone generator 30 can generate the musical tone signal in response to the control data from the CPU 10 indicating the key-depression, key-release, selected tone color, selected pitch and the like.

In addition, the tone generator 30 is coupled to a sound system 34 including an amplifier, a speaker and the like by which the musical tone is to be reproduced. In short, the musical tone signal formed by the tone generator 30 is supplied to the sound system 34, from which the corresponding musical tone is to be sounded.

(2) Instrument Body

Figure 2A:
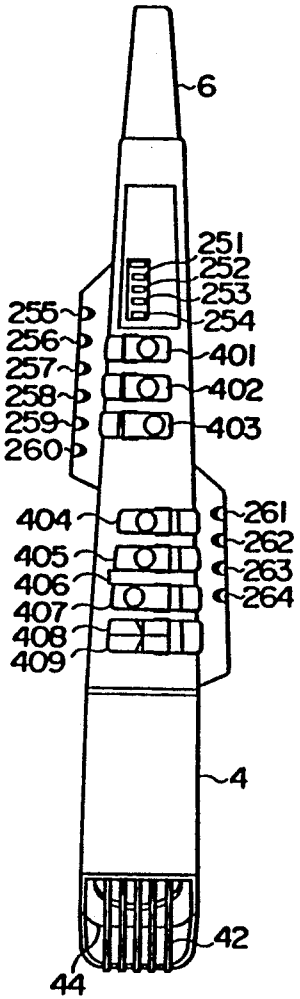
Figure 6:
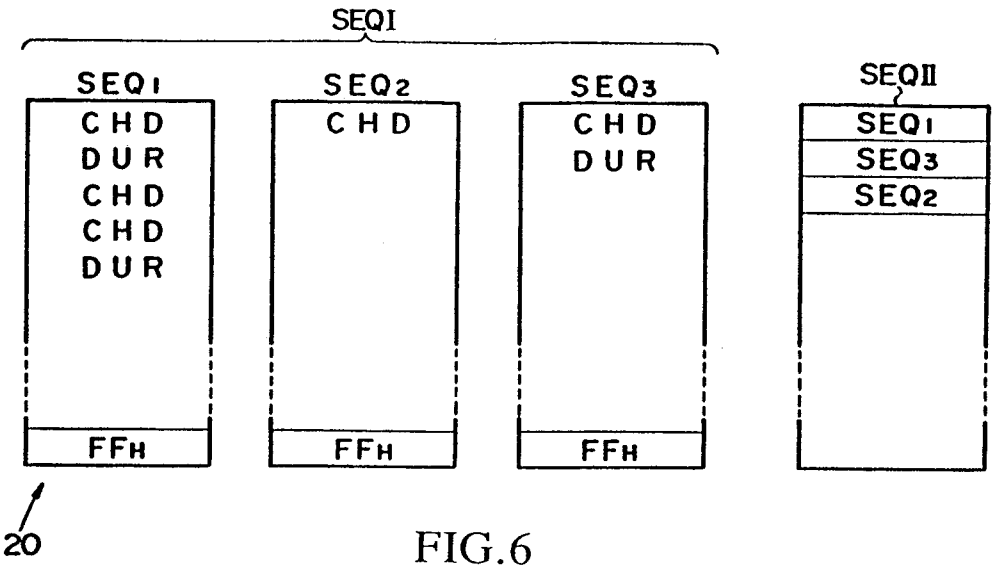
FIG. 6 shows a detailed contents of a sequencer memory shown in FIG. 1A.
Figure 8:
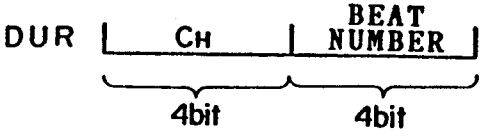
FIG. 8 shows duration data.

FIGS. 2A, 2B, 2C shows the mechanical construction of the instrument body 4 which is used as the electronic musical instrument according to the present embodiment.

Herein, the foregoing function circuit portion 2 is built in the instrument body 4. As shown in FIGS. 2A, 2B, the instrument body 4 having the appearance of wind instrument provides the mouth-piece 6 which is to be held at performer's mouth at one terminal portion thereof. When starting the tone-generation, the performer blows his breath into the mouth-piece 6. At the other terminal portion of the instrument body 4, an opening 42 is provided. Within such opening 42, a speaker 44 contained in the foregoing sound system 34 is mounted in order to generate the music sound.

On a front surface of the instrument body 4 near the mouth-piece 6, the sequencer selecting switches 251, 252, 253 and record switch 254 are mounted. Under the record switch 254, plural keys 401, 402, 403, 404, 405, 406, 407, 408, 409 are mounted in order to designate the desirable pitch. At one side portion of the instrument body 4, the rhythm change-over switches 255, 256, tempo speed changing switches 257, 258, start/stop switches 259, 260 are provided. At the other side portion, the tone color change-over switches 261, 262, transpose change-over switches 263, 264 are provided.

On a back surface of the instrument body 4 as shown in FIG. 2C, the ABC switch 265, octave switches 266, 267 and octave-down switch 268 are provided.

Figure 9A:
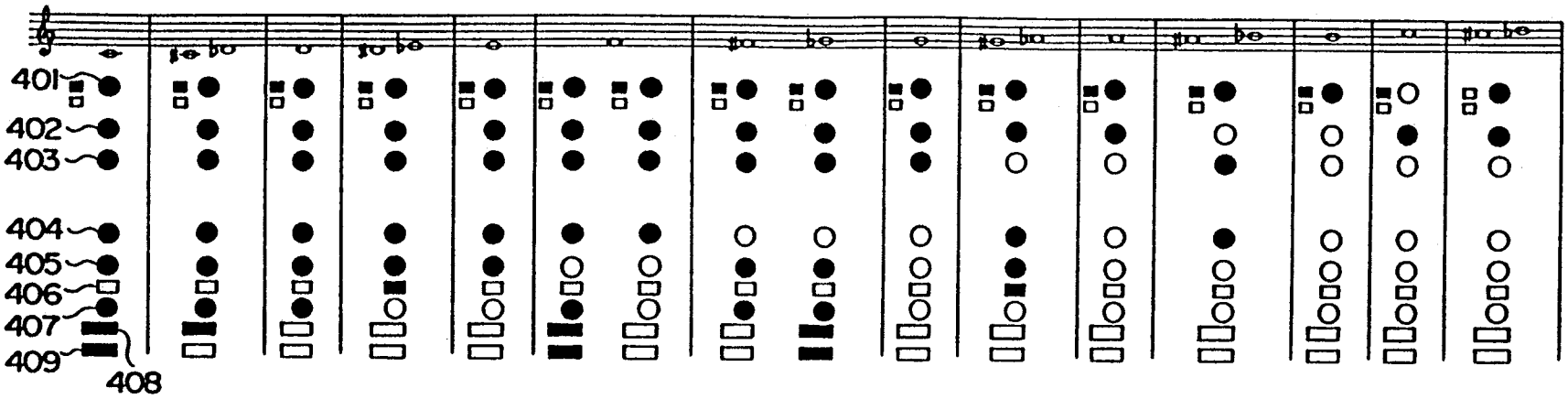
FIGS. 9A and 9B are scores indicating a relationship between a finger operation and a tone pitch.
Figure 9B:
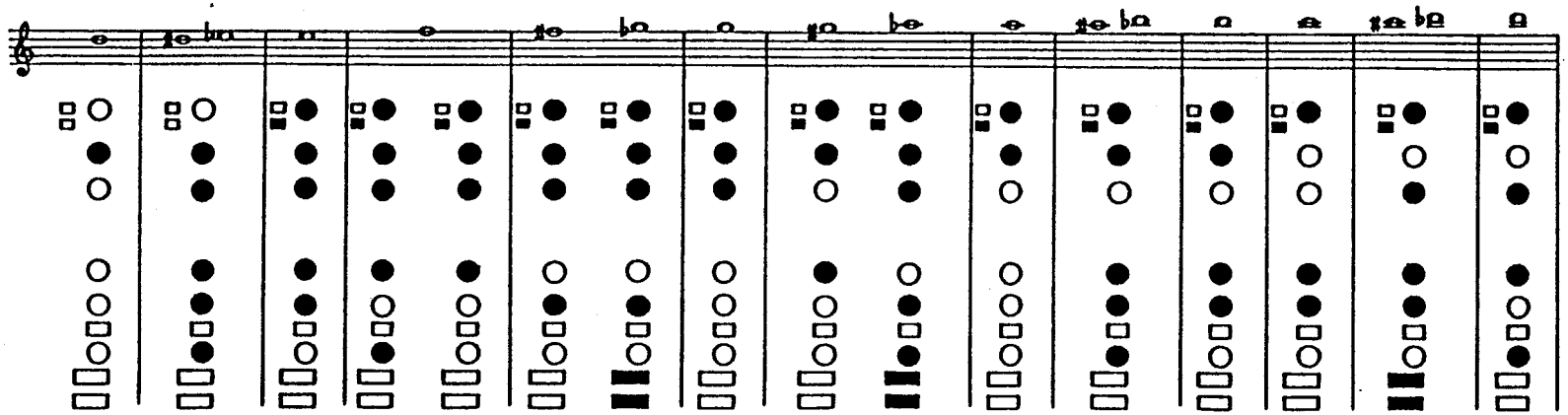

FIGS. 9A, 9B show the relationship between the finger operation and musical scale with respect to the keys 401 to 409 mounted on the instrument body 4. Herein, black mark "o" indicates that the key is closed (or operated), while white mark "o" indicates that the key is opened (or not operated).

(3) Breath Sensor

Figure 10:
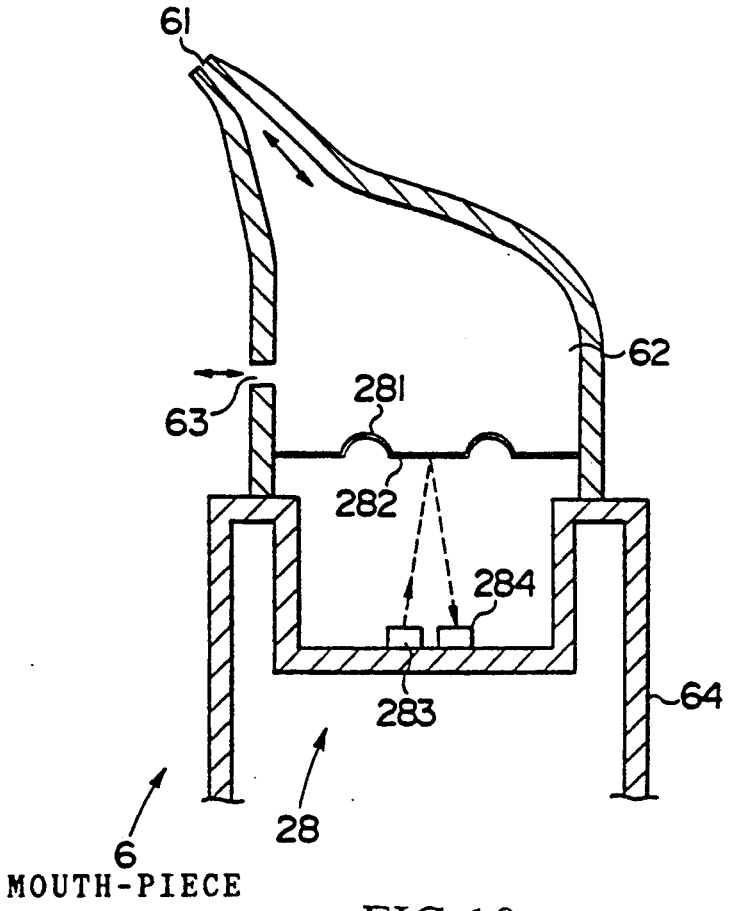
FIG. 10 is a sectional view showing the detailed construction of a mouth-piece in which a breath sensor shown in FIG. 1A is provided.

FIG. 10 is a sectional view of the breath sensor 28 which detects the breath pressure by use of the mouth-piece 6 mounted at an inlet portion of the instrument body 4 shown in FIG. 2.

In the mouth-piece 6, an inlet opening 61 is provided in order allow the performer to blow or draw air. In addition, an air cell 62 is provided within the mouth-piece 6 in order that the breath pressure applied to the inlet opening 61 can function. In order to obtain the breath-like effect between the inlet opening 61 and air cell 62, an air passage 63 is formed through the wall of the air cell 62. Further, a breath sensor 28 for electrically sensing the breath pressure applied by the performer is provided at a base portion of the mouth-piece 6 under the above-mentioned air cell 62. As this breath sensor 28, it is possible to use the breath pressure sensor as disclosed in Japanese Utility Model Publication No. 62-3827 entitled "BREATH PRESSURE SENSOR FOR ELECTRONIC WIND INSTRUMENT", for example.

Figure 11:
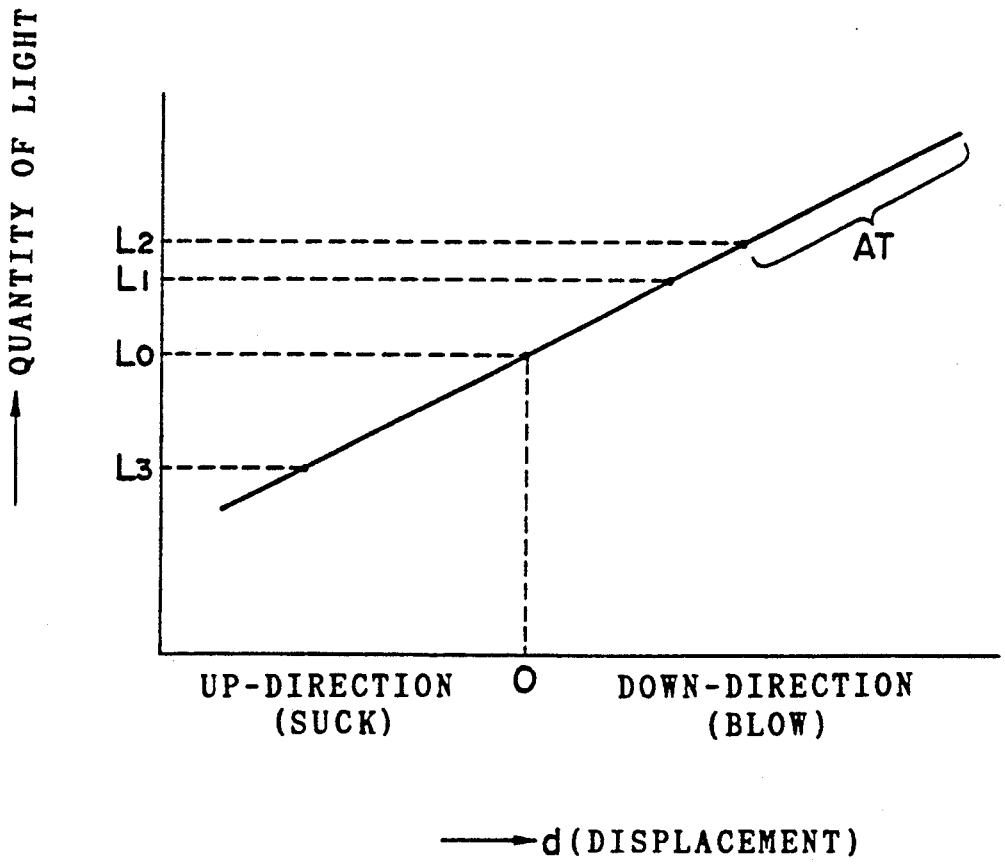
FIG. 11 is a graph showing an operation of the breath sensor.

The breath sensor 28 provides an elastic film 281 made of elastic materials such as rubber which expands and contracts in response to the breath pressure. At a back side of the elastic film 281, a pair of a light emitting diode (LED) 283 and a photo-transistor 284 are provided to convert the displacement of the elastic film 281 into a corresponding electric signal. More specifically, a reflection face 282 is formed at the back side of elastic film 281. In this case, the light emitted from the LED 283 is reflected by the reflection face 282 and then received by the photo-transistor 284. Herein, the shape of the elastic film 281 is varied in response to the breath pressure, so that the reflected light to be received by the photo-transistor 284 is varied in response to the breath pressure. As a result, the photo-transistor 284 outputs a level signal representing the breath pressure. For example, the elastic film 281 is lowered when the performer blows his breath into the mouth-piece 6, while the elastic film 281 is raised when the performer sucks his breath. In accordance with such up/down movement of the elastic film 281, the reflected light is varied. Therefore, the above-mentioned level signal represents the quantity of the light received by the photo-transistor 284. As shown in FIG. 11, the displacement of the elastic film 281 varies in response to the breath pressure, so that the level signal representing the breath pressure can be obtained from the photo-transistor 284. In FIG. 11, level $L_0$ is defined as the equilibrium point when the breath pressure is at zero level; and levels $L_1$, $L_2$ are set in relation to the key-off and key-on events respectively, wherein these levels are obtained when the performer blows his breath into the mouth-piece. In addition, level $L_3$ is defined as the suction detecting point which is obtained when the performer sucks his breath. Moreover, levels which is higher than the key-on level $L_2$ can be used to control the tone-generation by aftertouch AT.

B OPERATION OF EMBODIMENT

Next, description will be given with respect to each of the processes for several modes by referring to the flowcharts as shown in FIGS. 13 to 24.

(1) OPERATION MODE

First, description will be given with respect to the operation modes of the present electronic musical instrument as shown in FIGS. 1 to 2C by referring to the mode transition diagram shown in FIG. 12.

(a) NML Mode

In this NML mode (i.e., normal mode) where the automatic performance including the rhythm and accompaniment is stopped, the desirable pitch is designated by the key operation as shown in FIGS. 9A, 9B, and then the musical tone having the designated pitch is to be generated in response to the breath operation.

One of the NML mode and ABC mode is selected by operating the ABC switch 265. In addition, one of the NML mode and NML RUN mode is selected by operating the start/stop (ST/ST) switch 260. Further, when the state of ABC switch 265 does not designate the ABC mode, the mode can be changed from SEQ PLAY WAIT mode to the NML mode by operating the start/stop switch 260. By operating the sequencer selecting switches 251 to 253, the mode can be changed from the NML mode to the SEQ PLAY WAIT mode.

(b) ABC Mode

In this ABC mode, the auto-bass chord (ABC) is repeatedly reproduced.

As described above, one of the ABC mode and NML mode can be selected by operating the ABC switch 265. In addition, the ABC mode can be changed to ABC RUN mode by operating the start/stop switch 260, and the ABC mode can be changed to the SEQ PLAY WAIT mode by operating the sequencer selecting switches 251 to 253.

Further, by simultaneously depressing both of the sequencer selecting switches 251 to 253 and record switch 254, the ABC mode can be changed to SEQ PLAY WAIT mode.

(c) NML RUN Mode

In this NML RUN mode, the accompaniment is not performed automatically, but the accompaniment is performed with rhythm. In response to the key-on and breath operation, generation of the musical tone is to be started.

The NML RUN mode can be changed to the NML mode by operating the start/stop switch 260, and the NML mode can be changed to the ABC RUN mode by operating the ABC switch 265.

(d) ABC RUN Mode

In this ABC RUN mode, the automatic accompaniment is carried out in response to the breath operation.

The ABC RUN mode can be changed to the ABC mode by operating the start/stop switch 260, and the ABC RUN mode can be changed to the NML RUN mode by operating the ABC switch 265.

(e) SEQ REC WAIT Mode

In this SEQ REC WAIT mode, the sequencers $SEQ_1$ to $SEQ_3$ are set in the recording wait state when recording the chords.

When the ABC mode is released by operating the ABC switch 265, the SEQ REC WAIT mode can be directly changed to the NML mode by operating the start/stop switch 260.

If the ABC is operated in this SEQ REC WAIT mode, this mode can be changed to the ABC mode by operating the start/stop switch 260. More specifically, after the mode is changed from the ABC mode to the SEQ REC WAIT mode (where the ABC switch 265 is on so that ABC equals to "1"), the mode is further changed to the ABC mode by operating the start/stop switch 260. On the other hand, after the mode is changed from the NML mode to the SEQ REC WAIT mode (where ABC switch 265 is off so that ABC equals to "0"), the mode is further changed to the NML mode by operating the start/stop switch 260. When the breath-on event is occurred, the SEQ REC WAIT mode is changed to SEQ REC RUN mode.

(f) SEQ REC RUN mode

By operating the ABC switch 265 and record switch 254 in this SEQ REC RUN mode, the chords are recorded in the sequencers $SEQ_1$, $SEQ_2$, $SEQ_3$ within SEQ I, and data are sequentially read from these sequencers by the order stored in SEQ II.

After the ABC mode is changed to the SEQ REC RUN mode via the SEQ REC WAIT mode (where ABC switch 265 is on so that ABC equals to "1"), the SEQ REC RUN mode can be changed to the ABC mode by operating the start/stop switch 260. On the other hand, after the NML mode is changed to the SEQ REC RUN mode via the SEQ REC WAIT mode (where the ABC switch 265 is off so that ABC equals to "0"), the SEQ REC RUN mode can be changed to the NML mode by operating the start/stop switch 260.

(g) SEQ PLAY WAIT Mode

This SEQ PLAY WAIT mode indicates the wait state for waiting to reproduce the chords by the key operation and breath operation by activating the SEQ II.

After two bar periods are passed in this mode, this mode is changed to SEQ PLAY RUN mode. This SEQ PLAY WAIT mode is changed to the ABC mode by operating the start/stop switch 260 when the ABC is operated. Further, the ABC mode is changed to the SEQ PLAY WAIT mode by operating the sequencer selecting switches 251, 252, 253.

(h) SEQ PLAY RUN Mode

In this SEQ PLAY RUN mode, the access is given to the sequencers $SEQ_1$, $SEQ_2$, $SEQ_3$ respectively in accordance with the order stored in SEQ II so that the chords are reproduced in response to the key operation and breath operation.

If the ABC switch 265 is on (ABC=1) in this SEQ PLAY RUN mode, this mode can be changed to the ABC mode by operating the start/stop switch 260. On the other hand, if the ABC switch is off (ABC=0), this SEQ PLAY RUN mode can be changed to the NML mode by operating the start/stop switch 260.

Figure 12:
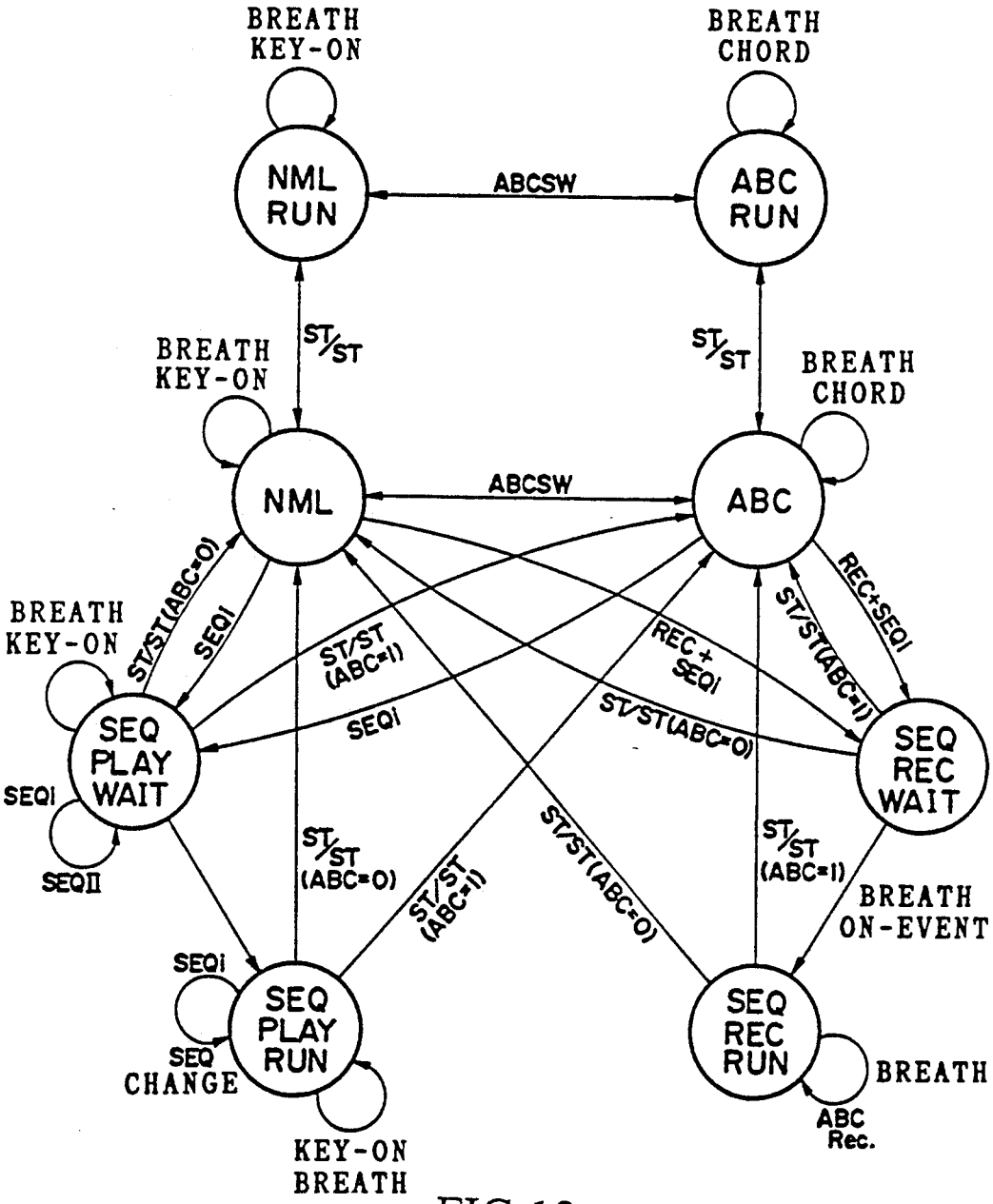
FIG. 12 is a mode transition diagram.

In accordance with the above-mentioned mode transition state as shown in FIG. 12, the present electronic musical instrument can generate the musical tone corresponding to the key information; record the chords in the sequencers $SEQ_1$, $SEQ_2$, $SEQ_3$ within SEQ I; store the data reading order in SEQ II with respect to these three sequencers; and perform the automatic accompaniment, rhythm and the like.

(2) INITIALIZATION MODE PROCESS

Figure 13:
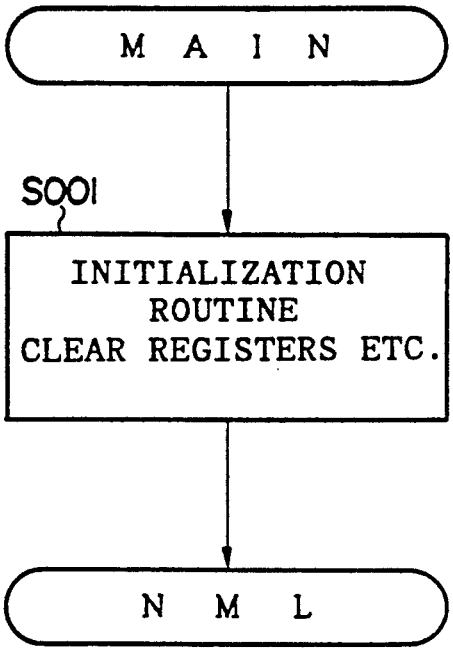
FIGS. 13 to 24 are flowcharts showing operations of an embodiment of the present invention.

FIG. 13 is a flowchart showing the initialization mode process of the present embodiment.

When the power switch (not shown) is on, the CPU 10 reads the control programs from the program memory 12 to thereby start its operations in accordance with the read control programs. When the power supply is made, the initialization mode is simultaneously set. In the first step S001 of this initialization mode process, initialization routine is activated so that the registers 14 are initialized. Then, the mode is changed to the NML mode.

(3) NML MODE PROCESS

Figure 14:
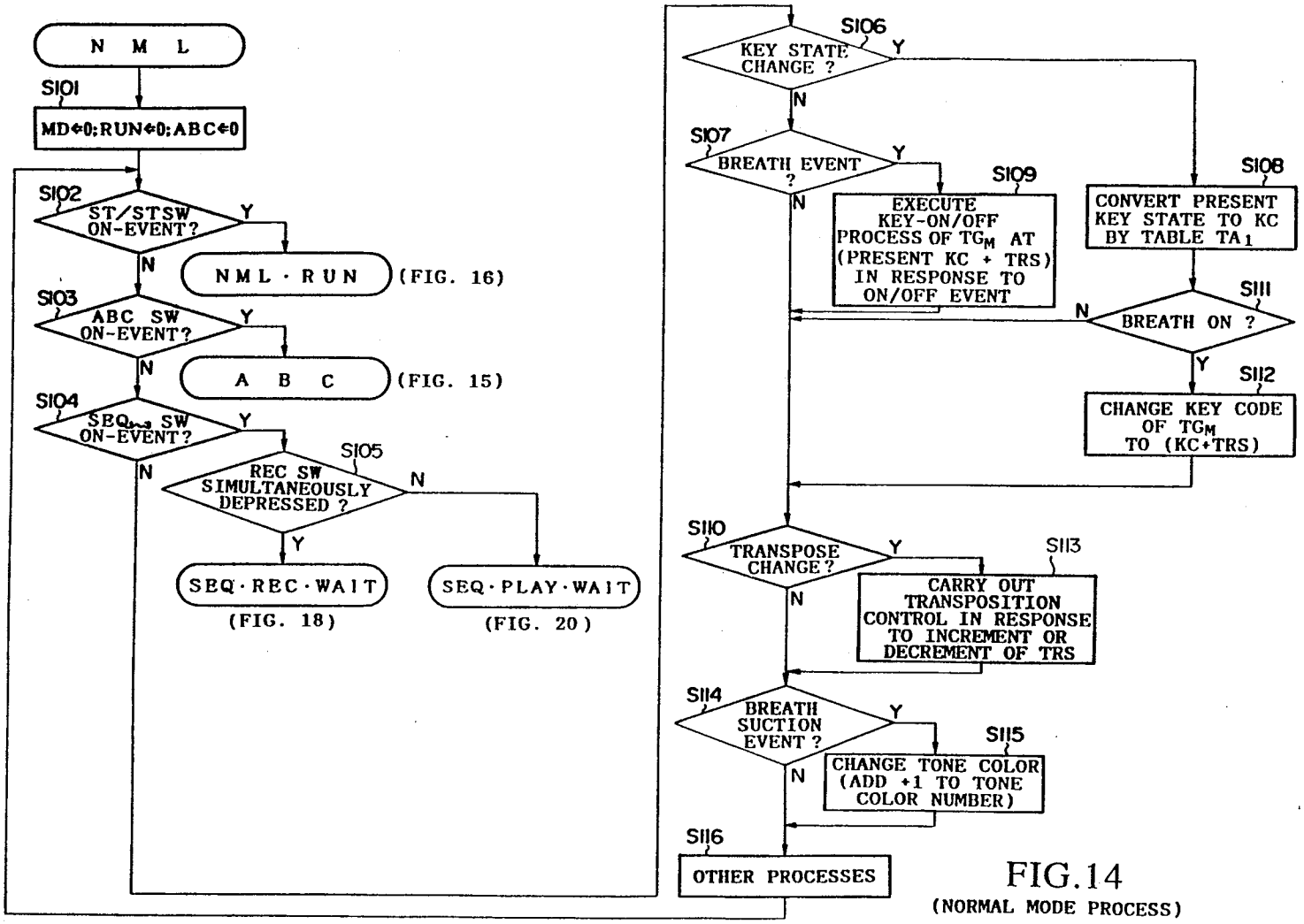

FIG. 14 is a flowchart showing the NML mode.

In first step S101 of this NML mode, data having value "0" (i.e., zero-data) is set in some of the registers 14. More specifically, the zero-data indicating the NML mode is set in a mode register MD; zero-data is set in a RUN register corresponding to the start/stop switch 260; and zero-data is set in a ABC register corresponding to the ABC switch 265.

In next step S102, it is judged whether or not the on-event is occurred on the start/stop switch 260. If the on-even is occurred on the start/stop switch 260 so that the judgement result of step S102 is "YES" represented by letter "Y", the NML mode is released so that the mode is changed to the NML RUN mode (see FIG. 16). If the on-event is not occurred on the start/stop switch 260 so that the judgement result of step S102 is "NO" represented by the letter "N", the processing proceeds to next step S103.

In step S103, it is judged whether or not the on-event is occurred on the ABC switch 265. If so, the NML mode is released and then changed to the ABC mode (see FIG. 15). If not, the processing proceeds to next step S104.

In step S104, it is judged whether or not the on-event is occurred on the sequencer selecting switches (i.e., $SEQ_1$ to $SEQ_3$ SW) 251 to 253. If any one of the sequencer selecting switches 251 to 253 is turned on, the processing proceeds to next step S105 wherein it is judged whether or not both of the sequencer selecting switch and record switch (i.e., REC SW) 254 are simultaneously depressed. If such simultaneous switch operation is detected so that the judgement result of step S105 is "YES", the NML mode is changed to the SEQ REC WAIT mode (see FIG. 18). On the other hand, if such simultaneous switch operation is not detected so that the judgement result step S105 is "NO", the NML mode is changed to the SEQ PLAY WAIT mode (see FIG. 20).

If the judgement process of step S104 judges that the any one of the sequencer selecting switches 251 to 253 is not turned on, the processing proceeds to step S106 wherein it is judged whether or not the key state is changed. Then, the processing proceeds to S107 when the key state is not changed, while the processing proceeds to step S108 when the key state is changed.

Meanwhile, when the foregoing breath sensor 28 detects the breath pressure, the breath event is detected by the CPU 10. In step S107, it is judged whether or not the breath event is occurred. If the breath event is occurred, the processing proceeds to step S109. If not, the processing proceeds to step S110.

In step S109, transpose data TRS indicating the transposition which is stored in certain register (which is provided within the registers 14 as the transposition storing means) is added to the present key code KC in response to the on/off event of the breath sensor 28. Based on the addition result, the key-on/off process is carried out on the tone generator $TG_M$. Thus, the transposition is carried out on the pitch based on the key information.

In step S108, the present key state is stored in the table $TA_1$ and then converted into the key code KC. Thereafter, the processing proceeds to step S111 wherein it is judged whether or not the breath is on. If the breath is not on, the processing proceeds to step S112. In step S112, the transpose data TRS is added to the present key code KC set in the tone generator $TG_M$ so as to output data (KC+TRS), and then the processing proceeds to step S110.

In step S110, it is judged whether or not the transpose switch 263, 264 is operated. In other words, it is judged whether or not the transposition is changed. If the transposition is changed, the processing proceeds to step S113. If not, the processing proceeds to step S114. In step S113, value "±1" is added to the present transpose data TRS. More specifically, TRS is incremented by operating the transpose switch 263, while TRS is decremented by operating the transpose switch 264. Herein, value "1" is set identical to 100 cents (corresponding to semitone). Thus, every time the transpose switch 263, 264 is depressed, the transpose data TRS is increased or decreased by the value corresponding to the semitone. Thereafter, the processing proceeds to step S114.

In step S114, in response to the breath pressure detected by the breath sensor 28, it is judged whether or not a breath suction event is occurred. If the breath suction event is detected so that the judgement result of step S114 turns to "YES", the processing proceeds to step S115. If not, the processing proceeds to step S116. In step S115, the tone color is changed by incrementing the present tone color number by "+1", and then the processing proceeds to next step S116. In step S116, the CPU 10 executes other processes such as tempo change process, rhythm select process, tone color select process. Thereafter, the processing returns to step S102 again.

(4) ABC MODE PROCESS

Figure 15:
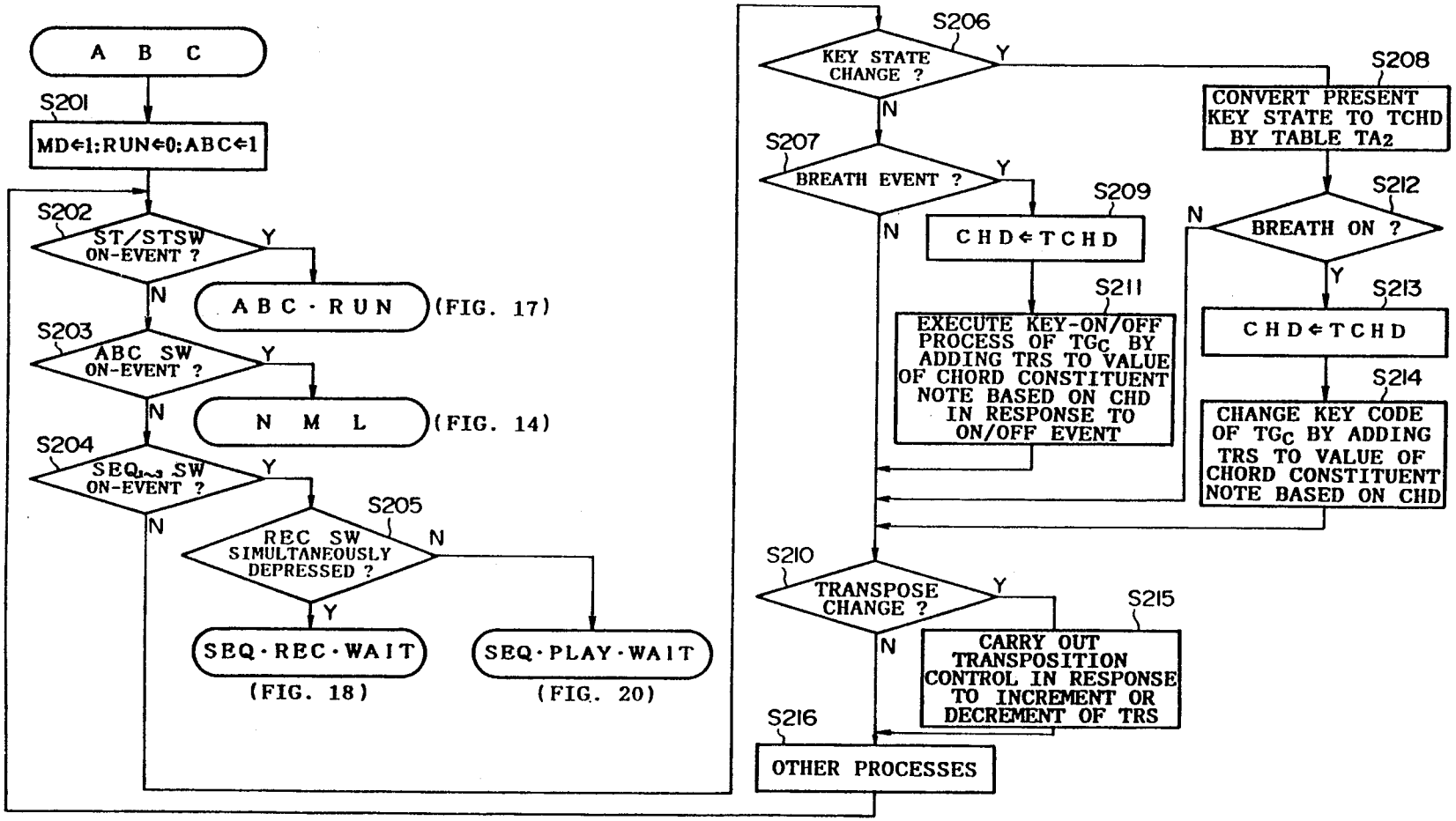

FIG. 15 is a flowchart showing the ABC (auto-bass chord) mode process.

In first step S201 of the ABC mode process, the zero-data indicating the ABC mode is set in the mode register MD; zero-data is set in the RUN register corresponding to the start/stop switch 260; and data having value "1" is set in the ABC register.

In next step S202, it is judged whether or not the on-event is occurred on the start/stop switch 260. If the on-event is occurred on the start/stop switch 260, the ABC mode is changed to the ABC RUN mode (see FIG. 17). If not, the processing proceeds to step S203.

In step S203, it is judged whether or not the on-event is occurred on the ABC switch 265. If the on-event is is occurred on the ABC switch 265, the ABC mode is changed to the NML mode (see FIG. 14). If not, the processing proceeds to step S204.

In step S204, it is judged whether or not the on-event is occurred on the sequencer selecting switch 251, 252, 253. If any one of the sequencer selecting switches is turned on, the processing proceeds to step S205. If none of the sequencer selecting switches is turned on, the processing proceeds to step S206. In step S205, it is judged whether or not the record switch 254 is simultaneously depressed with the sequencer selecting switch. If such simultaneous switch operation is detected, the ABC mode is changed to the SEQ PLAY WAIT mode (see FIG. 20).

In step S206, it is judged whether or not the key state is changed due to the key operation. If the key state is not changed, the processing proceeds to step S207.

In step S207, it is judged whether or not the breath event is occurred. If the breath event is occurred, the processing proceeds to step S209. If not, the processing proceeds to step S210. In step S209, chord data TCHD is stored in a CHD register. Then, the processing proceeds to step S211 wherein in response to the on/off event of the breath sensor 28, the transpose data TRS is added to the value representative of the chord constituent note based on the contents of CHD register so that the key-on/off process is carried out on the tone generator $TG_C$. Thereafter, the processing proceeds to step S210.

Meanwhile, if it is judged that the key state is changed in step S206, the processing proceeds from step S206 to step S208 wherein the present key state is stored in the table $TA_2$ so as to output the chord data TCHD. Then, the processing proceeds to step S212.

In step S212, it is judged whether or not the breath is on. Then, the processing proceeds to step S213 when the breath is on, while the processing proceeds to another step S210 when the breath is not on.

In step S213, the chord data TCHD is stored in the CHD register. In next step S214, the key chord is changed in the tone generator $TG_C$ by adding the transpose data TRS to the value representative of the chord constituent note based on the contents of CHD register. Then, the processing proceeds to step S210.

In step S210, it is judged whether or not the transposition is changed. If the transposition is changed, the processing proceeds to step S215. If not, the processing proceeds to step S216. In step S215, the performance control is carried out in response to the increment or decrement of the transpose data TRS. Then, the processing proceeds to step S216.

In step S216, the CPU 10 carries out the processes such as the tempo change process, rhythm select process, tone color select process etc. Thereafter, the processing returns back to step S202.

(5) NML RUN MODE PROCESS

Figure 16:
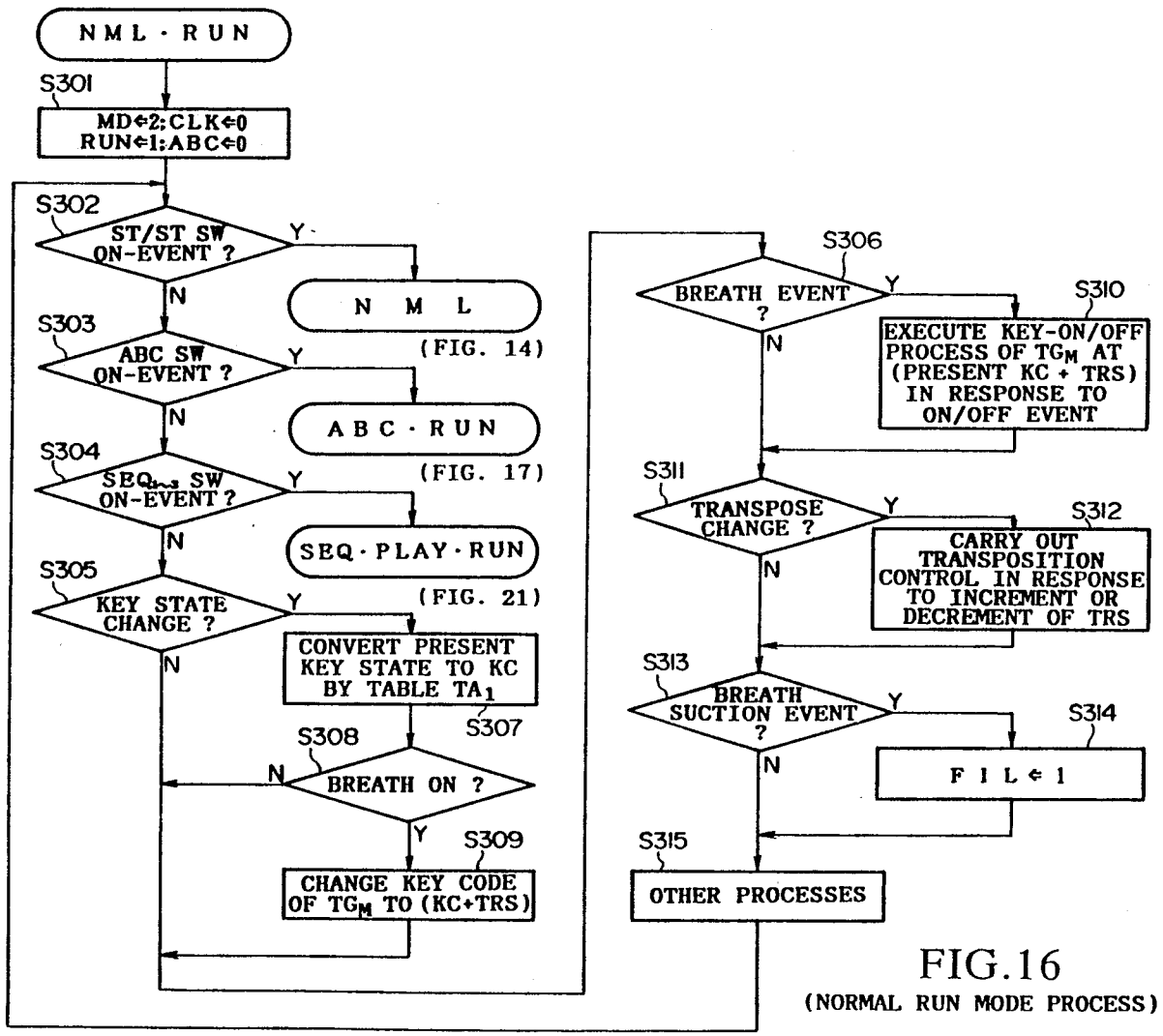

FIG. 16 is a flowchart showing the NML RUN mode process.

In first step S301 of this NML RUN mode process, data value "2" indicating the NML RUN mode is set in the mode register MD; data value "1" is set in the RUN register; a tempo clock register CLK is cleared; and data value "0" is set in the ABC register within the registers 14.

In next step S302, it is judged whether or not the on-event is occurred on the start/stop switch 260. If the start/stop switch 260 is operated so that its on-event is occurred, the NML RUN mode is canceled and then changed to the NML mode (see FIG. 14). If not, the processing proceeds to step S303.

In step S303, it is judged whether or not the on-event is occurred on the ABC switch 265. If the on-event is occurred on the ABC switch 265, the NML RUN mode is canceled and then changed to the ABC RUN mode (see FIG. 17). If not, the processing proceeds to step S304.

In step S304, it is judged whether or not the on-event is occurred on the sequencer selecting switch 251, 252, 253. If any one of the sequencer selecting switches is turned on, the NML RUN mode is changed to the SEQ PLAY RUN mode (see FIG. 21). If not, the processing proceeds to step S305. Such mode transition from the NML RUN mode to the SEQ PLAY RUN mode is omitted and not shown in the foregoing mode transition diagram of FIG. 12.

In step S305, it is judged whether or not the key state is changed. If the key state is not changed, the processing proceeds to step S306. If the key state is changed, the processing proceeds to step S307. In step S307, the present key state is converted into the key code KC by the table $TA_1$. Then, the processing proceeds to step S308.

In step S308, it is judged whether or not the breath is on. If the breath is on, the processing proceeds to step S309. If not, the processing proceeds to step S306.

In step S309, the key code KC set in the tone generator $TG_M$ is changed to data (KC+TRS) indicating the value which is obtained by adding the transpose data TRS to the present key code KC. Then, the processing proceeds to step S306.

In step S306, it is judged whether or not the breath event is occurred. If the breath event is occurred, the processing proceeds to step S310. If not, the processing proceeds to step S311. In step S310, in response to the on/off event of the breath, the transpose data TRS is added to the present key code so as to output data (KC+TRS). Based on this data (KC+TRS), the key-on/off process is carried out on the tone generator $TG_M$.

In step S311, it is judged whether or not the transposition is changed. If the transposition is changed, the processing proceeds to step S312. If not, the processing proceeds to step S313. In step S312, the transposition control is carried out in response to the increment or decrement of the transpose data TRS. Then, the processing proceeds to step S313.

In step S313, it is judged whether or not the breath suction event is occurred by detecting the breath-sucking pressure applied to the breath sensor 28. If the breath suction event is detected, the processing proceeds to step S314. If not, the processing proceeds to step S315. In step S314, in order to carry out rhythm fill-in control, data value "1" is set in a FIL register provided within the registers 14. Herein, a fill-in switch (not shown) is used to change the normal pattern to the fill-in pattern in the rhythm performance.

In step S315, the CPU 10 carries out the processes such as tempo change process, rhythm select process, tone color select process etc. Thereafter, the processing returns back to step S302.

Incidentally, generation of the rhythm tone which is controlled in this NML RUN mode will be carried out in a CLK IRQ process which will be described later.

(6) ABC RUN MODE PROCESS

Figure 17:
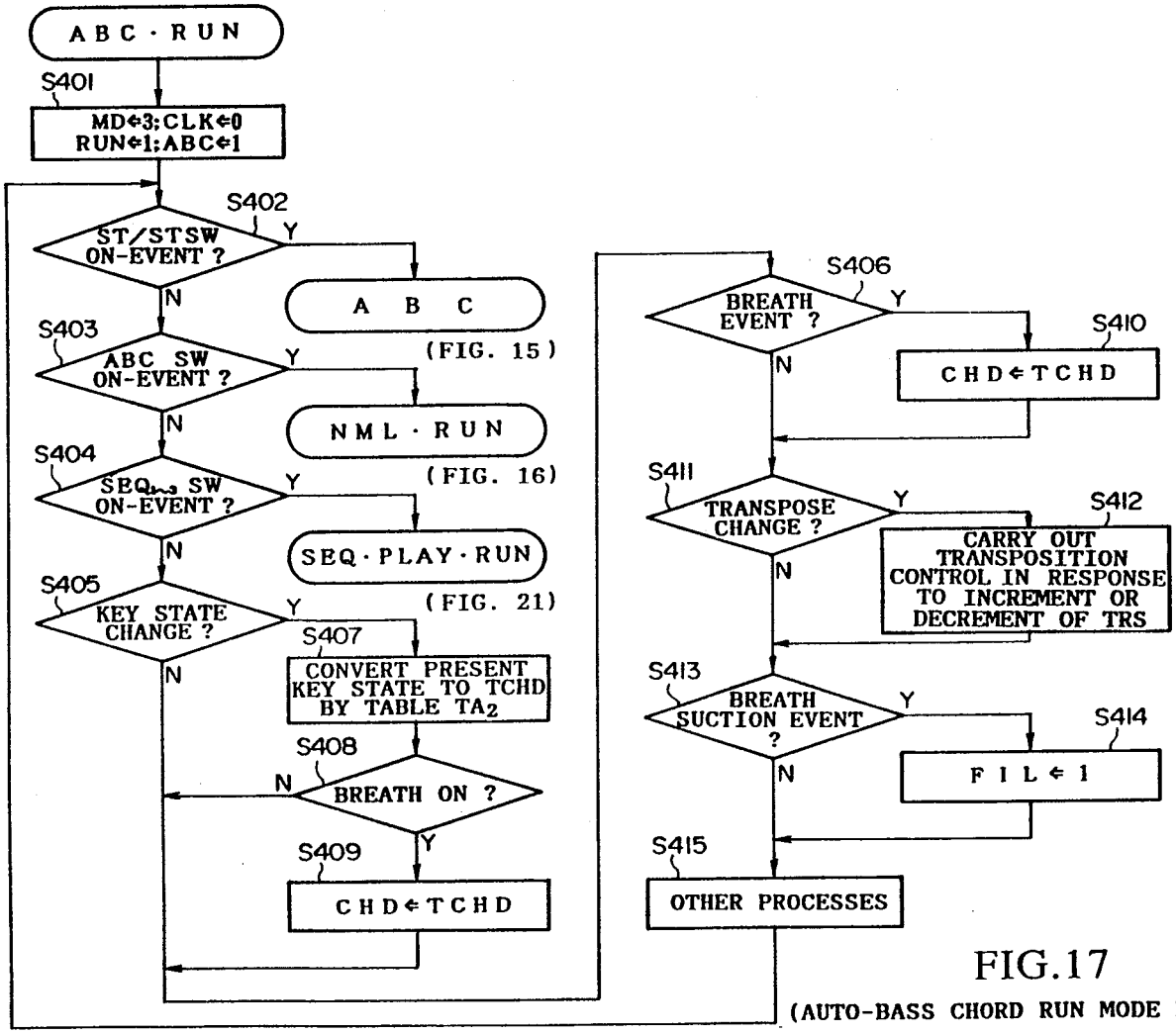

FIG. 17 is a flowchart showing the ABC RUN mode process.

In first step S401 of this ABC RUN mode process, data value "3" indicating the ABC RUN mode is set in the mode register MD; data value "1" is set in the RUN register corresponding to the start/stop switch 260; a tempo clock register CLK is cleared; and data value "1" is set in the ABC register by operating the ABC switch.

In next step S402, it is judged whether or not the on-event is occurred on the start/stop switch 260. If the start/stop switch 260 is turned on, the ABC RUN mode is changed to the ABC mode (see FIG. 15). If not, the processing proceeds to step S403.

In step S403, it is judged whether or not the on-event is occurred on the ABC switch 265. If the on-event is occurred on the ABC switch 265, the ABC RUN mode is changed to the NML RUN mode (see FIG. 16). If not, the processing proceeds to step S404.

In step S404, it is judged whether or not the on-event is occurred on the sequencer selecting switches 251 to 253. If any one of the sequencer selecting switches is turned on, the ABC RUN mode is changed to the SEQ PLAY RUN mode (see FIG. 21). If any of them is not turned on, the processing proceeds to step S405.

Incidentally, the mode transition from the ABC RUN mode to the SEQ PLAY RUN mode is omitted from and not shown in FIG. 12.

In step S405, it is judged whether or not the key state is changed. If the key state is not changed, the processing proceeds to step S406. If the key state is changed, the processing proceeds to step S407.

In step S407, the present key state is converted into the chord data TCHD by the table $TA_2$. Then, the processing proceeds to step S408 wherein it is judged whether or not the breath is on. If the breath is on, the processing proceeds to step S409. If not, the processing proceeds to step S406.

In step S409, the above-mentioned chord data TCHD which is obtained in step S407 is stored in the CHD register. Then, the processing proceeds to step S406.

In step S406, it is judged whether or not the breath event is occurred. If the breath event is detected, the processing proceeds to step S410. If not, the processing proceeds to step S411. In step S410, the chord data TCHD is stored in the CHD register. Then, the processing proceeds to step S411.

In step S411, it is judged whether or not the transposition is changed. If the transposition change is detected, the processing proceeds to step S412. If not, the processing proceeds to step S413. In step S412, the transposition control is carried out in response to the increment or decrement of the transpose data TRS. Then, the processing proceeds to step S413.

In step S413, it is judged whether or not the breath suction event is occurred by detecting the breath-sucking pressure applied to the breath sensor 28. If the breath suction event is detected, the processing proceeds to step S414. If not, the processing proceeds to step S415. In step S414, data value "1" is set in the FIL register in order to carry out the fill-in control of the ABC tone. Then, the processing proceeds to step S415.

In step S415, the CPU 10 carries out the other processes such as tempo change process, rhythm select process, tone color select process etc. Thereafter, the processing returns back to step S402.

Incidentally, generation of the ABC tone which is controlled in this mode will be carried out in the CLK IRQ process.

(7) SEQ REC WAIT MODE PROCESS

Figure 18:
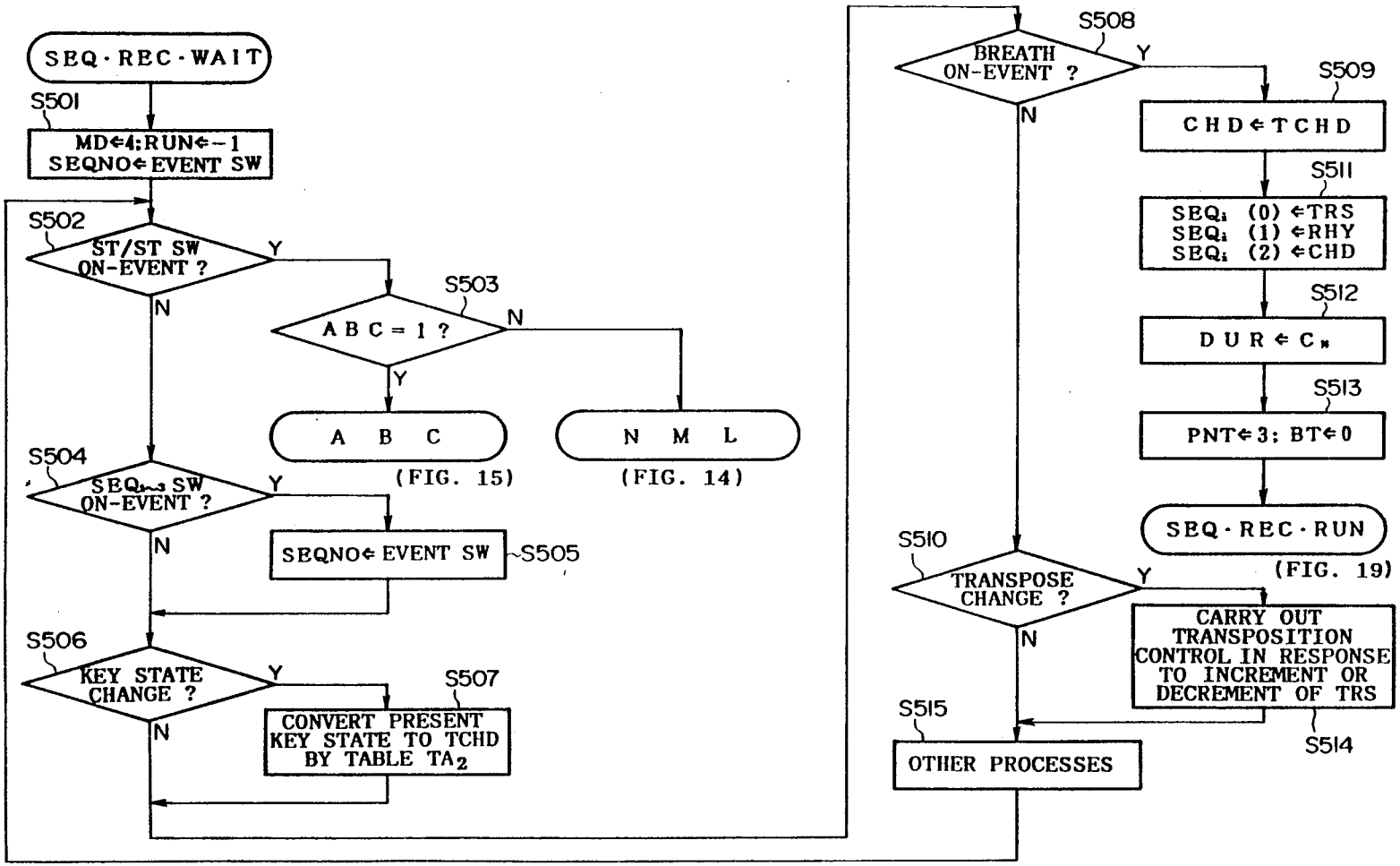

FIG. 18 is a flowchart showing the SEQ REC WAIT mode process.

In first step S501 of this SEQ REC WAIT mode, data value "4" indicating the SEQ REC WAIT mode is set in the mode register MD; data value "−1" is set in the RUN register; and data indicating one of the sequencer selecting switches to be selected is set in a SEQNO register.

In next step S502, it is judged whether or not the on-event is occurred on the start/stop switch 260. If the on-event of the start/stop switch 260 is detected, the processing proceeds to step S503. If not, the processing proceeds to step S504.

In step S503, the mode transition is carried out in response to the data stored in the ABC register. When the data of ABC register is at "1", the SEQ REC WAIT mode is changed to the ABC mode (see FIG. 15). When the data of ABC register is at "0", the SEQ REC WAIT mode is changed to the NML mode (see FIG. 14).

In step S504, it is judged whether or not the on-event is occurred on the sequencer selecting switches 251 to 253. If any one of the sequencer selecting switches is turned on, the processing proceeds to step S505. If not, the processing proceeds to step S506.

In step S505, the sequencer number indicating one of the sequencers $SEQ_1$, $SEQ_2$, $SEQ_3$ which is selected by operating one of the sequencer selecting switches is designated and then stored in the SEQNO register. Then, the processing proceeds to step S506.

In step S506, it is judged whether or not the key state is changed. If the key state is changed, the processing proceeds to step S507. If not, the processing proceeds to step S508. In step S507, the present key state is converted into the chord data TCHD by the table $TA_2$. Then, the processing proceeds to step S508.

In step S508, it is judged whether or not the breath event is occurred. If the breath event is detected, the processing proceeds to step S509. If not, the processing proceeds to step S510.

In step S509, the chord data TCHD which is obtained by referring to the table $TA_2$ is stored in the CHD register as the chord data CHD. Then, the processing proceeds to step S511 wherein the transpose data TRS (representative of the transposition value), rhythm data RHY and chord data CHD are stored in the sequencer $SEQ_i$ (where $i=1$, 2 or 3) corresponding to the value of SEQNO register.

In next step S512, the predetermined value $C_H$ is stored in upper-four-bit area of the DUR register.

Herein, root data having the value ranging from $O_H$ to $B_H$ included in the chord data CHD as its upper four bits. Therefore, in order to discriminate from such root data, the above-mentioned predetermined value $C_H$ is stored in the DUR register.

Then, the processing proceeds to step S513 wherein data value "3" is set in a pointer PNT; and data value "0" is set in a BT register. Thereafter, the SEQ REC WAIT mode is changed to the SEQ REC RUN mode (see FIG. 19).

In the SEQ REC RUN mode, the recording is carried out from the address $SEQ_i$ (3).

In step S510, it is judged whether or not the transposition is changed. If the transposition is changed, the processing proceeds to step S514. If not, the processing proceeds to step S515. In step S514, the transposition control is carried out in response to the increment or decrement of the transpose data TRS. Then, the processing proceeds to step S515.

In step S515, the CPU 10 carries out the other processes such as the tempo change process, rhythm select process, tone color select process etc. Thereafter, the processing returns back to step S502.

(8) SEQ REC RUN MODE PROCESS

Figure 19:
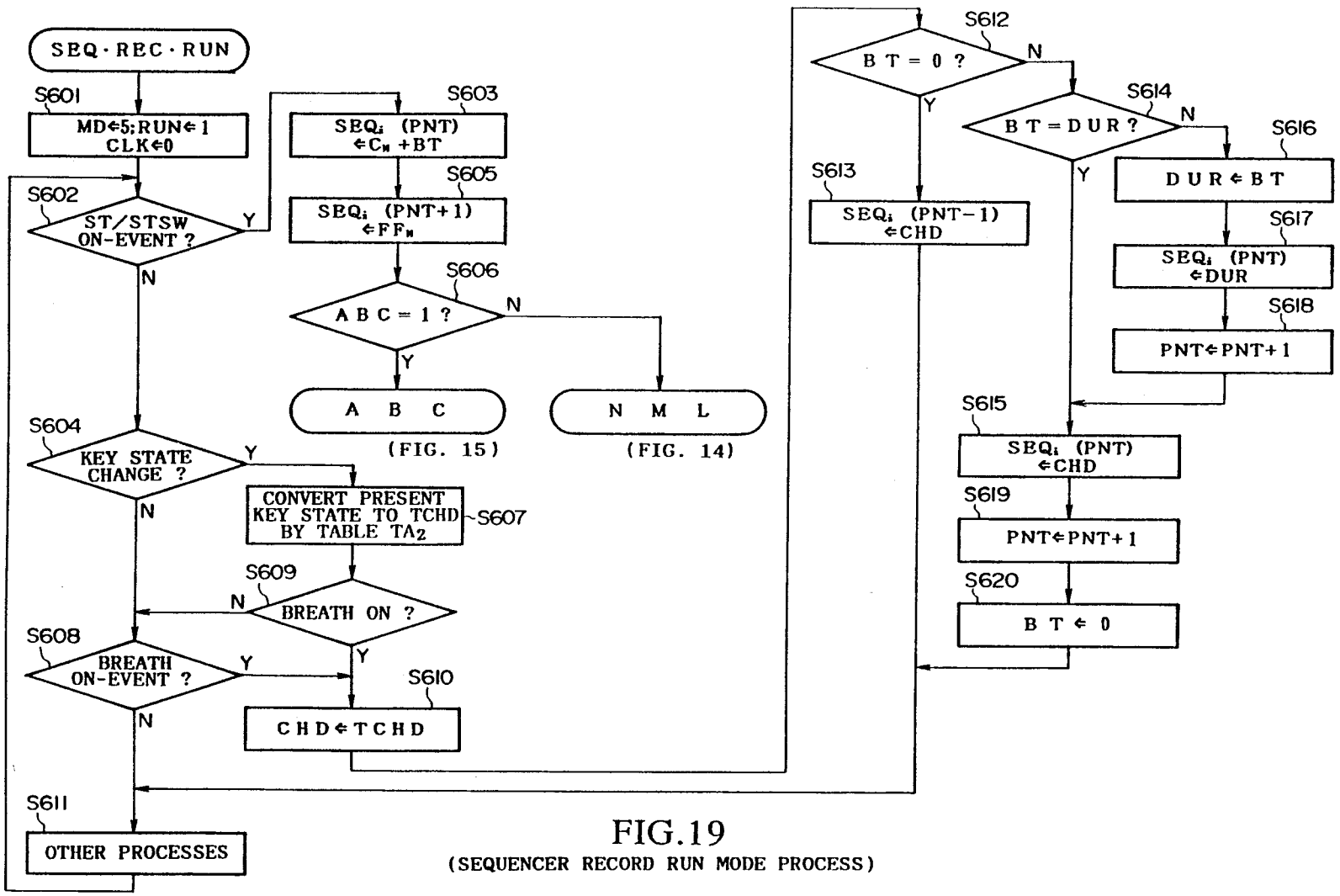

FIG. 19 is a flowchart showing the SEQ REC RUN mode process.

In first step S601 of the SEQ REC RUN mode, data value "5" indicating the SEQ REC RUN mode is set in the mode register MD; data value "1" is set in the RUN register; and the tempo clock register CLK is cleared.

In next step S602, it is judged whether or not the on-event is occurred on the start/stop switch 260. If the start/stop switch 260 is operated so that its on-event is detected, the processing proceeds to step S603. If not, the processing proceeds to step S604.

In step S603, data ($C_H$+BT) is stored in the sequencer $SEQ_i$ (PNT) designated by the pointer PNT. Then, the processing proceeds to step S605 wherein sequence end data $FF_H$ is stored in the sequencer $SEQ_i$ (PNT+1) next to $SEQ_i$ (PNT). Then, the processing proceeds to step S606 wherein the mode transition is made in response to the value of ABC register. If the value of ABC register is at "1", the SEQ REC RUN mode is changed to the ABC mode (see FIG. 15). If not, the SEQ REC RUN mode is changed to the NML mode (see FIG. 14).

In step S604, it is judged whether or not the key state is changed. If the key state is changed, the processing proceeds to step S607. If not, the processing proceeds to step S608. In step S607, the present key state is converted into the chord data TCHD by the table $TA_2$. Then, the processing proceeds to step S609.

In step S609, it is judged whether or not the breath is on. If the breath is on, the processing proceeds to step S610. If not, the processing proceeds to step S608.

In step S608, it is judged whether or not the breath event is occurred. If the breath event is detected, the processing proceeds to step S610. If not, the processing proceeds to step S611. In step S610, the chord data TCHD which is obtained by referring to the table $TA_2$ is stored in the CHD register. Then, the processing proceeds to step S612.

In step S612, it is judged whether or not the value of BT register is at "0". If the value of BT register is at "0", the processing proceeds to step S613. If not, the processing proceeds to step S614.

In step S613, the data of CHD register is stored in the sequencer $SEQ_i$(PNT-1) designated by the point PNT. Then, the processing proceeds to step S611.

The above-mentioned process of step S613 is available in order to invalidate the preceding key operation which is made by mistake so that the performer wants to change such preceding key operation.

In step S614, it is judged whether or not the value of BT register coincides with that of DUR register. If they coincide with each other, the processing proceeds to step S615. If not, the processing proceeds to step S616.

In the present embodiment, when the precedingly stored time interval data coincides with the presently stored time interval data, the coincidence between the BT register and DUR register is detected in the above-mentioned process of step S614. In this case, the time interval data (i.e., value of DUR register) is not stored in the sequencer.

In step S616, the data of BT register is stored in lower-four-bit area of the DUR register. Then, the processing proceeds to step S617 wherein the data of DUR register is stored in the sequencer $SEQ_i$(PNT) designated by the pointer PNT. In next step S618, the data of pointer PNT is incremented by "1". Then, the processing proceeds to step S615. In step S615, the data of CHD register is stored in the sequencer $SEQ_i$(PNT). In next step S619, the data of pointer PNT is incremented by "1". Then, the processing proceeds to step S620 wherein the value of BT register is cleared to "0". Thereafter, the processing returns back to step S611.

Incidentally, generation of the ABC tone which is controlled in this mode will be carried out in the CLK IRQ process.

(9) SEQ PLAY WAIT MODE PROCESS

Figure 20:
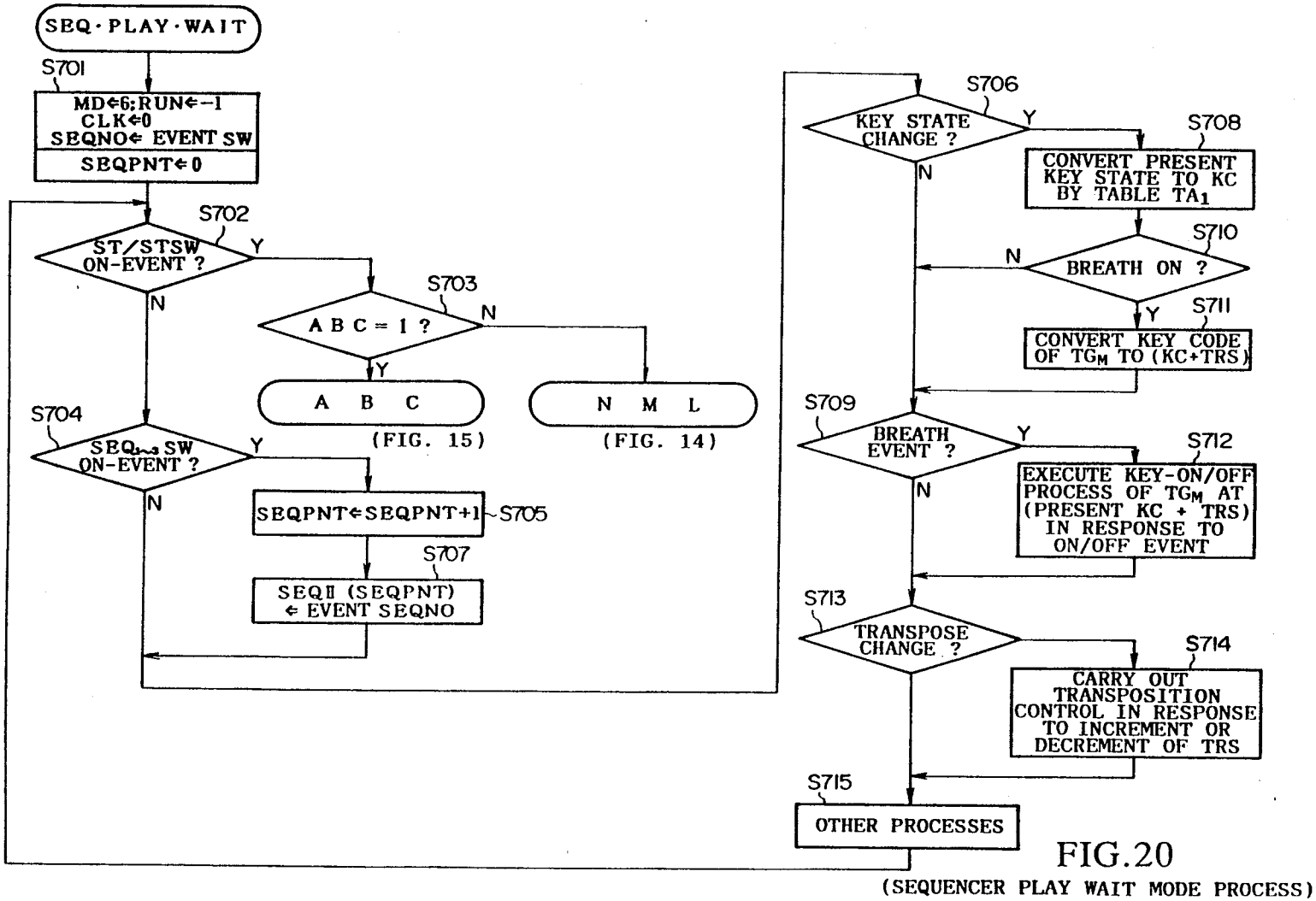

FIG. 20 is a flowchart showing the SEQ PLAY WAIT mode process.

In first step S701 of this SEQ PLAY WAIT mode process, data value "6" indicating the SEQ PLAY WAIT mode is set in the mode register MD; and data value "−1" is set in the RUN register within the registers 14. In addition, one of the sequencers $SEQ_1$, $SEQ_2$, $SEQ_3$ set within SEQ I is designated in response to the operation of the sequencer selecting switch. Further, the CPU 10 clears a register SEQPNT and the tempo clock register CLK. Thereafter, the processing proceeds to step S702.

In step S702, it is judged whether or not the on-event is occurred on the start/stop switch 260. If the on-event of the start/stop switch 260 is detected, the processing proceeds to step S703. If not, the processing proceeds to step S704.

In step S703, the mode transition is carried out in response to the data of ABC register. More specifically, if the data of ABC register is at "1", the SEQ PLAY WAIT mode is changed to the ABC mode (see FIG. 15). If the on-event is not occurred on the ABC switch 265, the SEQ PLAY WAIT mode is changed to the NML mode (see FIG. 14).

In step S704, it is judged whether or not the on-event is occurred on the sequencer selecting switches 251 to 253. If any one of the sequencer selecting switches is turned on, the processing proceeds to step S705. If not, the processing proceeds to step S706.

In step S705, data value "1" is added to the data stored in the pointer SEQPNT. Then, the processing proceeds to step S707 wherein the number of event SEQ is stored in the area designated by the pointer PNT within SEQ II. After executing the process of step S707, the processing proceeds to step S706. Incidentally, the value of tempo clock register CLK is counted up every time the CLK IRQ process is executed. When this value reaches "98" (i.e., CLK=98), the tempo clock register CLK is cleared, by which the mode is automatically changed to the SEQ PLAY RUN mode. The above-mentioned processes of steps S704 to S707 correspond to the operation of setting the reproduction order of the musical tones to be reproduced.

In step S706, it is judged whether or not the key state is changed. If the key state is changed, the processing proceeds to step S708. If not, the processing proceeds to step S709.

In step S708, the present key state is converted into the key code KC by the table $TA_1$. In next step S710, it is judged whether or not the breath is on. If the breath is on, the processing proceeds to step S711. If not, the processing proceeds to step S709.

In step S711, the key code KC set in the tone generator $TG_M$ is converted to data (KC+TRS) by adding the transpose data TRS thereto. Then, the processing proceeds to step S709.

In step S709, it is judged whether or not the breath event is occurred. If the breath event is detected, the processing proceeds to step S712. If not, the processing proceeds to step S713.

In step S712, the key-on/off process is carried out on the tone generator $TG_M$ with respect to the data (KC+TRS) in response to the on/off event of the breath. Then, the processing proceeds to step S713 wherein it is judged whether or not the transposition change is carried out by operating the transpose change-over switches 263, 264. If the transposition is changed, the processing proceeds to step S714. If not, the processing proceeds to step S715. In step S714, the transposition control is carried out in response to the increment or decrement of the transpose data TRS. Then, the processing proceeds to step S715.

In step S715, the CPU 10 carries out the other processes such as the tempo change process, rhythm select process, tone color select process etc. Thereafter, the processing returns back to step S702.

(10) SEQ PLAY RUN MODE PROCESS

Figure 21:
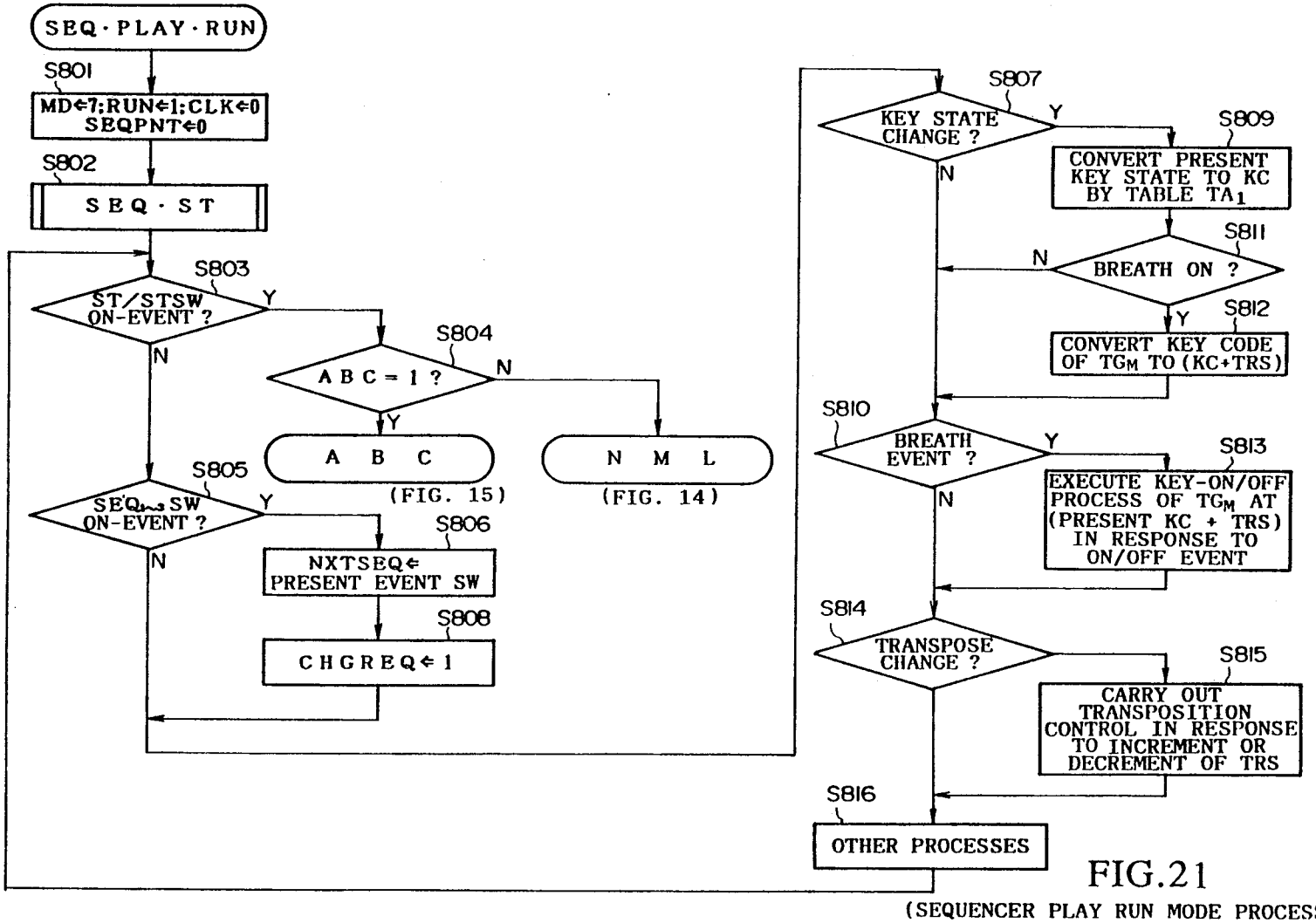

FIG. 21 is a flowchart showing the SEQ PLAY RUN mode process.

In first step S801 of this SEQ PLAY RUN mode process, data value "7" indicating the SEQ PLAY RUN mode is set in the mode register MD; data value "1" is set in the RUN register corresponding to the start/stop switch 260; the tempo clock register CLK and register SEQPNT are cleared. Then, the processing proceeds to step S802.

Figure 22:
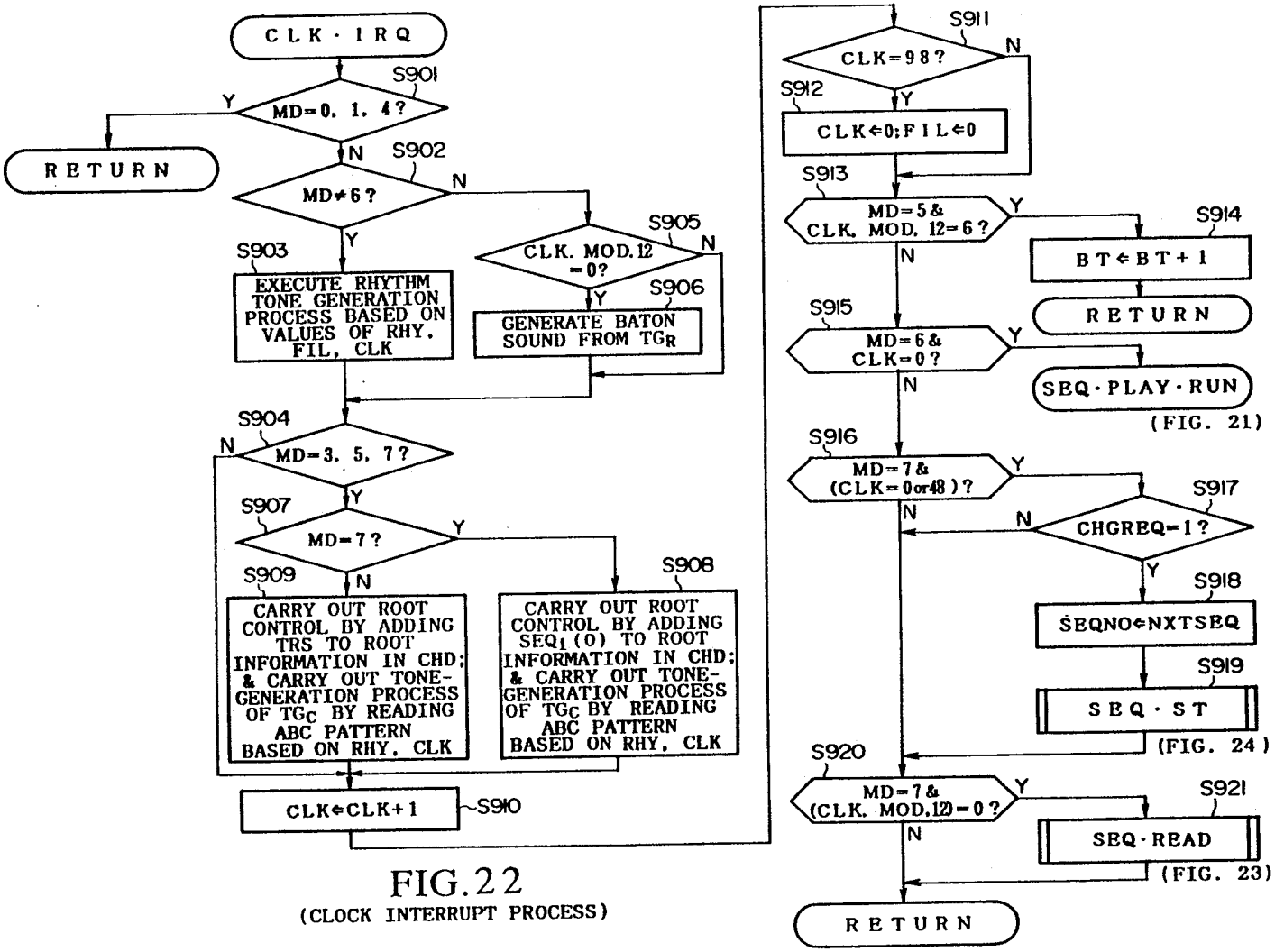

In step S802, a sequencer sub-routine as shown in FIG. 22 is activated so that initial data to be read out is set in the sequencer $SEQ_1$, $SEQ_2$ or $SEQ_3$. Then, the processing proceeds to step S803.

In step S803, it is judged whether or not the on-event is occurred on the start/stop switch 260. If the start/-stop switch 260 is operated so that its on-event is detected, the processing proceeds to step S804. If not, the processing proceeds to step S805.

In step S804, the mode transition is carried out in response to the data of ABC register. More specifically, when the data of ABC register is at "1", the SEQ PLAY RUN mode is changed to the ABC mode (see FIG. 15). On the other hand, if the on-event is not occurred on the ABC switch, the SEQ PLAY RUN mode is changed to the NML mode (see FIG. 14).

In next step S805, it is judged whether or not the on-event is occurred on the sequencer selecting switches 251 to 253. If the on-event is occurred on the sequencer selecting switch, the processing proceeds to step S806. If not, the processing proceeds to step S807. In step S806, the data which is generated by operating the present event switch is stored in a register NXTSEQ in order to change the reproduction order. Then, the processing proceeds to step S808 wherein in order to carry out the interrupt process, data value "1" is stored in a change request register CHGREQ. After executing the process of step S808, the processing proceeds to step S807.

In step S807, it is judged whether or not the key state is changed. If the key state is changed, the processing proceeds to step S809. If not, the processing proceeds to step S810. In step S809, the present key state is converted into the key code KC by the table $TA_1$. Then, the processing proceeds to step S811 wherein it is judged whether or not the breath is on. If the breath is on, the processing proceeds to step S812. If not, the processing proceeds to step S810.

In step S812, the key code KC set in the tone generator $TG_M$ is converted into the data (KC+TRS). Then, the processing proceeds to step S810.

In step S810, it is judged whether or not the breath event is occurred. If the breath event is detected, the processing proceeds to step S813. If not, the processing proceeds to step S814.

In step S813, the key-on/off process is carried out on the tone generator $TG_M$ with respect to the data (KC+TRS) in response to the on/off event of the breath.

In next step S814, it is judged whether or not the transposition is changed. If the transposition change is detected, the processing proceeds to step S815. If not, the processing proceeds to step S816. In step S815, the transposition control is carried out in response to the transpose data TRS which is incremented or decremented by operating the transpose change-over switches 263, 264. Then, the processing proceeds to step S816.

In step S816, the CPU 10 carries out the other processes such as the tempo change process, rhythm select process, tone color select process etc. Thereafter, the processing returns back to step S803.

Incidentally, generation of the ABC tone which is controlled in this mode will be carried out in the following CLK IRQ process.

(11) CLK IRQ PROCESS

FIG. 22 is a flowchart showing the CLK IRQ process (i.e., clock interrupt process).

In first step S901 of this CLK IRQ process, it is judged whether or not the data set in the mode register MD is at "0", "1" or "4". If the data of mode register MD is at one of these values, the processing returns to its original process. If not, the processing proceeds to step S902. In step S902, it is judged whether or not the data of mode register MD is at "6". If the data of mode register MD is not at "6" so that the judgement result of step S902 is "YES" (i.e., "Y"), the processing proceeds to step S903 wherein the tone generator $TG_R$ generates the rhythm tone based on the values of the RHY register, FIL register and tempo clock register CLK. Then, the processing proceeds to step S904.

On the other hand, if the judgement process of step S902 judges that the data of mode register MD is at "6", the processing proceeds to step S905 wherein it is judged whether or not the remainder of the operation of dividing the value of tempo clock register CLK by "12" (i.e., CLK.MOD.12) is at "0". If such remainder is at "0", the processing proceeds to step S906. If not, the processing proceeds to step S904. In step S906, the tone generator $TG_R$ is controlled to generate the baton sound. Then, the processing proceeds to step S904.

In step S904, it is judged whether or not the data of mode register MD is at "3", "5" or "7". If the data of mode register MD is at one of these values, the processing proceeds to step S907. If not, the processing directly proceeds to step S910. In step S907, it is judged whether or not the data of mode register MD is at "7". If the data of mode register MD is at "7", the processing proceeds to step S908. If not, the processing proceeds to step S909.

In step S908, the value of sequencer $SEQ_1(O)$ is added to ROOT information stored in the CHD register so as to carry out the root control. Then, the ABC pattern is read out based on the values of RHY register and tempo clock register CLK. Thus, the tone generator $TG_C$ generates the chord based on the read ABC pattern. Due to the process of step S908, the transposition value of the ABC tone to be sounded under control of the sequencer is set identical to the value which is stored at first. Thereafter, the processing proceeds to step S910.

In step S909, the transpose data TRS is added to the ROOT information of CHD register so as to carry out the root control. Based on the values of RHY register and tempo clock register CLK, the corresponding ABC pattern is read out. Thus, the tone generator $TG_C$ generates the chord based on the read ABC pattern. Then, the processing proceeds to step S910. Due to the process of step S909, the present transposition value is set for the ABC tone to be sounded based on the key operation.

In the present embodiment, if the judgement process of step S904 judges that the data of mode register MD is not at any one of the values "3", "5" and "7", the processing proceeds from step S904 to step S910 as described before.

In step S910, "1" is added to the value of tempo clock register CLK. Then, the processing proceeds to next step S911 wherein it is judged whether or not the value of tempo clock register CLK becomes equal to "98". When the value of tempo clock register CLK reaches "98", the processing proceeds to step S912 wherein both of the values of tempo clock register CLK and FIL register are set at "0". Then, the processing proceeds to step S913. On the other hand, if the judgement process of step S911 judges that the value of tempo clock register CLK is smaller than "98", the processing proceeds to step S913.

In step S913, it is judged whether or not the data of mode register MD is at "5", and it is also judged whether or not the remainder of the operation of dividing the value of tempo clock register CLK by "12" (i.e., CLK.MOD.12) becomes equal to "6".

If the above-mentioned judgement process of step S913 judges that the data of mode register MD is at "5" and the remainder is at "6", the processing proceeds to step S914 wherein "1" is added to the value of BT register. After executing the process of step S914, the processing returns to its original process.

On the other hand, if the judgement process of step S913 judges that the data of mode register MD is not at "5" or the remainder is not at "6", the processing proceeds to step S915. In step S915, it is judged whether or not the value of mode register MD is at "6" and the value of tempo clock register CLK is at "0". If so, the mode transition is made from the present CLK IRQ process to the foregoing SEQ PLAY RUN mode process (see FIG. 21).

If the judgement process of step S915 judges that the data of mode register MD is not at "6" or the value of tempo clock register CLK is not at "0", the processing proceeds to step S916. In step S916, it is judged whether or not the data of mode register MD is at "7" and the value of tempo clock register CLK is at "0" or "48". If so, the processing proceeds to step S917. If not, the processing proceeds to step S920.

In step S917, it is judged whether or not the change request register CHGREQ is at "1". If so, the processing proceeds to step S918. If not, the processing proceeds to step S920.

In step S918, the value of register NXTSEQ is stored in another register SEQNO. This process of step S918 corresponds to the foregoing process of changing the data reading order in the middle of the reproduction. After executing the process of step S918, the processing proceeds to step S919.

In step S919, a SEQ ST mode process (see FIG. 24) is to be executed. Then, the processing proceeds to step S920.

In step S920, it is judged whether or not the data of mode register MD is at "7" and the remainder of the operation of dividing the value of tempo clock register CLK by "12" is at "0". If so, the processing proceeds to step S921. If not, the processing returns back to its original process. In step S921, the following SEQ READ mode process (see FIG. 23) is to be executed.

(12) SEQ READ MODE PROCESS

Figure 23:
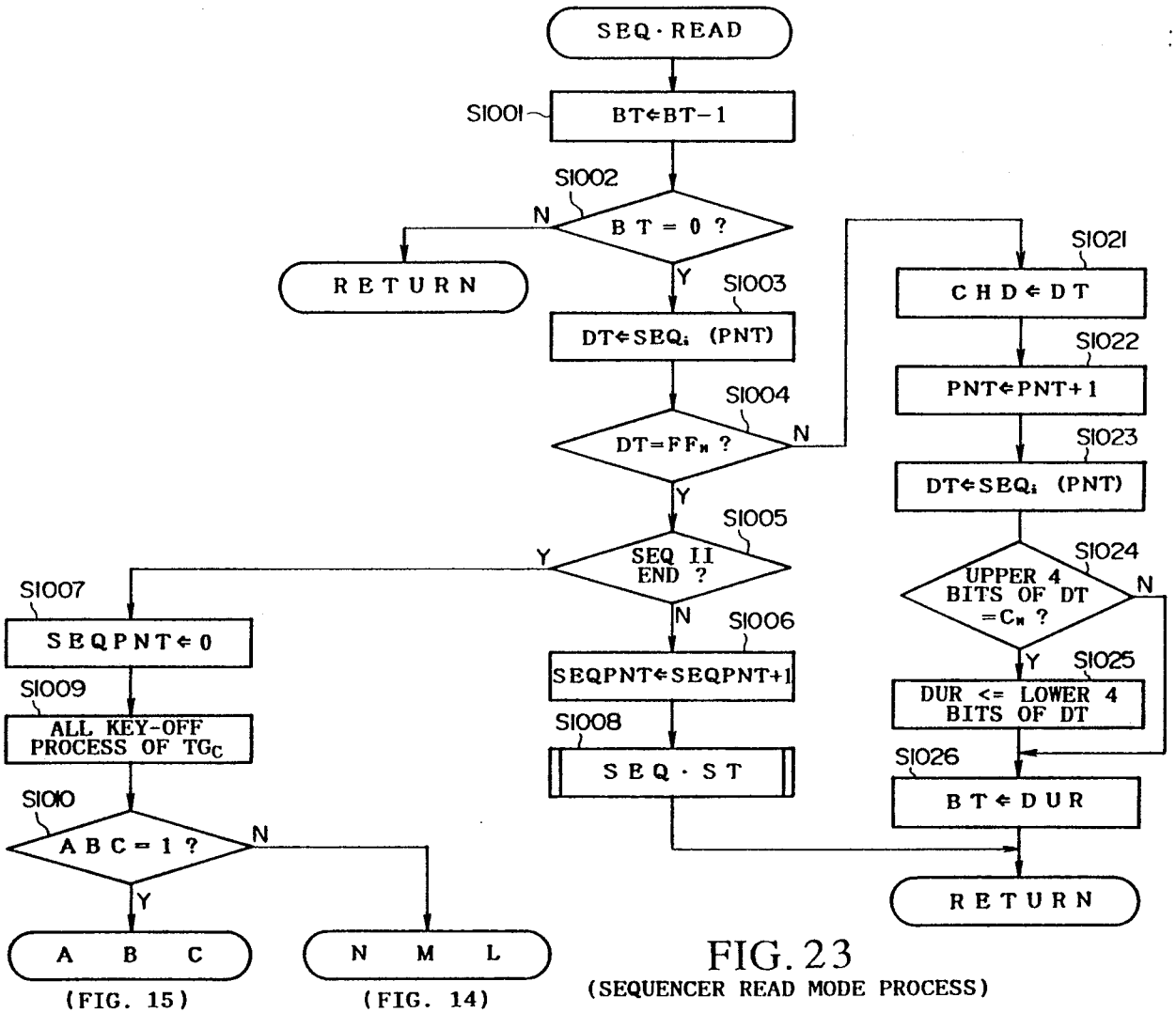

FIG. 23 is a flowchart showing the SEQ READ mode process.

In first step S1001 of this SEQ READ mode process, the data of BT register is decremented by "1". Then, the processing proceeds to next step S1002.

In step S1002, it is judged whether or not the value of BT register is at "0". In case of "BT≠0", the processing returns back to its original process. In case of "BT=0", the processing proceeds to step S1003.

In step S1003, the data of one of the sequencers $SEQ_1$, $SEQ_2$, $SEQ_3$ to be selected by the pointer PNT is stored in a DT register. In next step S1004, it is judged whether or not the data stored in the DT register indicates data "$FF_H$" representative of the last value of the selected sequencer. In case of "DT=$FF_H$", the processing proceeds to step S1005 wherein it is judged whether or not the order set in SEQ II is completed. If so, the processing proceeds to step S1007. If not, the processing proceeds to step S1006. In step S1006, data value "1" is added to the present data of pointer SEQPNT. In next step S1008, the SEQ ST mode process (see FIG. 24) is to be executed. Then, the processing returns back to its original process. Meanwhile, in step S1007, data value "0" is stored in the pointer SEQPNT. After executing this process of step S1007, the processing proceeds to step S1009.

In step S1009, the all key-off process for the accompaniment is carried out in the tone generator $TG_C$. Then, the processing proceeds to step S1010 wherein it is judged whether or not the data of ABC register is at "1". If the data of ABC register is at "1", the mode transition is made from the present SEQ READ mode to the foregoing ABC mode. If not, the mode transition is made from the SEQ READ mode to the NML mode.

Meanwhile, if the judgement process of step S1004 judges that the data $FF_H$ is not set in the DT register, the processing proceeds to step S1021 wherein the data of DT register is transmitted to the CHD register. In next step S1022, data value "1" is added to the present data of pointer PNT. In step S1023, the data of the sequencer $SEQ_i$(PNT) designated by the pointer PNT is stored in the DT register. Then, the processing proceeds to step S1024.

In step S1024, it is judged whether or not the upper four bits of the data stored in the DT register indicate the data $C_H$. If so, the upper four bits of the data of DT register indicates the time interval. Then, the processing proceeds to step S1025. In step S1025, the lower four bits of the data of DT register are stored in the DUR register. Then, the processing proceeds to step S1026. On the other hand, if the upper four bits of the data of DT register do not indicate the data $C_H$, they must represent the chord. In this case, the processing directly proceeds from step S1024 to step S1026. In step S1026, the data of BT register is stored in the DUR register. Thereafter, the processing returns back to its original process.

(13) SEQ ST MODE PROCESS

Figure 24:
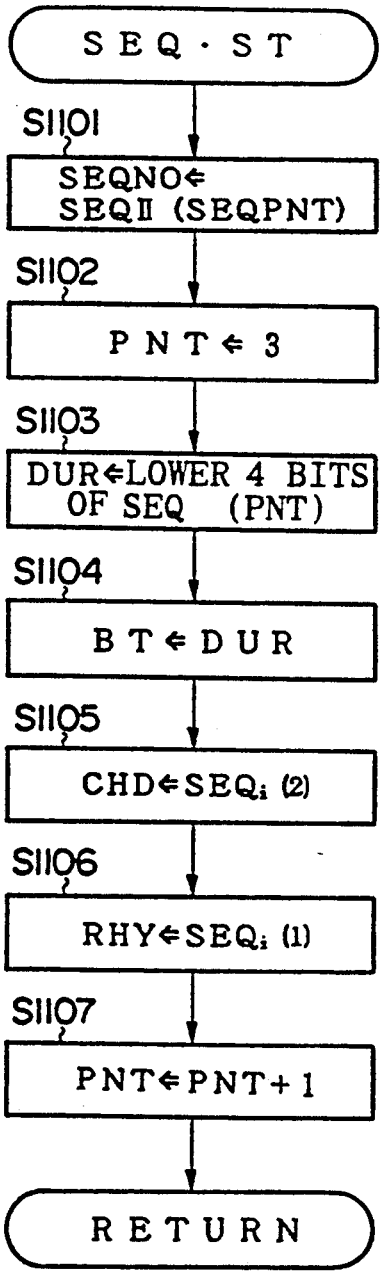

FIG. 24 is a flowchart showing the SEQ ST mode process.

In first step S1101 of this SEQ ST mode process, the data stored in SEQII(SEQPNT) is stored in the SEQNO register. In next step S1102, data value "3" is stored in the pointer PNT. In step S1103, the lower four bits of the data stored in the sequencer $SEQ_i$(PNT) are stored in the DUR register. In step S1104, the lower four bits of the data of DUR register are stored in the BT register. In step S1105, the data of the sequencer $SEQ_i$(2) is stored in the CHD register. In step S1106, the data of the sequencer $SEQ_i$(1) is stored in the RHY register. In step S1107, the pointer PNT is incremented. Thereafter, the processing returns back to its original process.

The preferred embodiment of the present invention is configured and operates as described heretofore.

This invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

(a) designating means for designating a tone pitch;

(b) detecting means for detecting breath pressure including breath blowing pressure and breath sucking pressure to be applied by a performer; and (c) control means for controlling generation of a musical tone signal corresponding to the tone pitch designated by said designating means based on the breath blowing pressure to be detected, and for controlling a predetermined musical parameter of the musical tone signal based on the breath sucking pressure to be detected.

2. An electronic musical instrument according to claim 1 having a shape like a wind instrument to which the performer's breath is applied.

3. An electronic musical instrument according to claim 1, wherein the predetermined musical parameter represents a tone color.

4. An electronic musical instrument according to claim 1 wherein the predetermined musical parameter represents at least one of accompaniment and rhythm.

5. An electronic musical instrument comprising:

(a) designating means for designating a desirable tone pitch of a first musical tone to be generated;

(b) memory means for storing musical tone information corresponding to a second musical tone to be generated;

(c) transposition setting means for setting a transposition applied to the first musical tone to be generated;

(d) transposition storing means for storing transposition information indicating the transposition set by the transposition setting means; and (e) transposition control means for selectively applying the transposition to the first musical tone designated by the designating means based on the transposition information, and (f) automatic performance generating means for generating a automatic performance based on the first musical tone to which the transposition is applied by the transposition control means and the second musical tone based on the musical tone information.

6. An electronic musical instrument comprising:

(a) a plurality of data banks each pre-storing automatic performance data;

(b) selecting means for selecting one of the plurality of data banks;

(c) memory means for storing an order by which the data banks are sequentially selected;

(d) reproduction designating means for designating a musical tone to be reproduced; and (e) control means for setting the memory means at a write enable state for a predetermined time after the reproduction designating means designates that the musical tone is to be reproduced, thereby enabling the storing of an order by which the data banks are sequentially selected, the control means sequentially designating the data banks by the order stored in the memory means after the predetermined time is passed so that the automatic performance data are sequentially read from said data banks, and (f) automatic performance generating means for generating an automatic performance based on the automatic performance data sequentially read from the data banks under control of the control means.

* * * * *